US007415805B2

(12) United States Patent
Nickerson

(10) Patent No.: US 7,415,805 B2
(45) Date of Patent: Aug. 26, 2008

(54) WALL SYSTEM WITH MASONRY EXTERNAL SURFACE AND ASSOCIATED METHOD

(76) Inventor: David L. Nickerson, P.O. Box 1000 Freight House Rd., West Brookfield, MA (US) 01585-1000

( * ) Notice: Subject to any disclaimer, the term of this patent is extended or adjusted under 35 U.S.C. 154(b) by 877 days.

(21) Appl. No.: 10/728,588

(22) Filed: Dec. 8, 2003

(65) Prior Publication Data

US 2005/0120659 A1 Jun. 9, 2005

(51) Int. Cl.
*E04B 2/00* (2006.01)

(52) U.S. Cl. ..... 52/426; 52/442; 52/424; 52/309.11

(58) Field of Classification Search ..... 52/426, 52/442, 431, 309.11, 418, 424, 565, 677
See application file for complete search history.

(56) References Cited

U.S. PATENT DOCUMENTS 4,706,429 A * 11/1987 Young ..... 52/309.12
4,730,422 A * 3/1988 Young ..... 52/105
4,731,968 A * 3/1988 Obino ..... 52/309.12
4,936,540 A 6/1990 Boeshart
5,209,039 A 5/1993 Boeshart
5,347,781 A 9/1994 Hanlon
5,409,193 A 4/1995 Baxter
5,509,636 A 4/1996 Cotugno
5,570,552 A * 11/1996 Nehring ..... 52/426
D378,049 S * 2/1997 Boeshart ..... D8/354
5,701,710 A * 12/1997 Tremelling ..... 52/426
5,724,782 A 3/1998 Rice et al.
5,852,907 A 12/1998 Tobin et al.
5,890,337 A 4/1999 Boeshart
5,987,830 A 11/1999 Worley
6,079,176 A 6/2000 Westra
6,176,059 B1 1/2001 Cantarano et al.
6,224,031 B1 5/2001 Boeshart
6,256,962 B1 7/2001 Boeshart
6,293,067 B1 9/2001 Meendering
6,308,484 B1 10/2001 Severino
6,351,918 B1 3/2002 Westra et al.
6,352,237 B1 * 3/2002 Severino ..... 249/194

* cited by examiner

*Primary Examiner*—Basil Katcheves
(74) *Attorney, Agent, or Firm*—Deborah A. Basile; Karen K. Chadwell

(57) ABSTRACT

An improved wall system comprising a plurality of blocks formed at least partially of a masonry material, a layer of an insulative material, and a layer of a curable or settable material interposed between the blocks and the layer of insulative material. The blocks may provide the wall with a masonry external surface or an exterior surface that is substantially aesthetically completed upon arrangement of the blocks and prior to the pouring of the layer of curable or settable material. In an alternate embodiment, ties may extend between a pair of blocks to form a construction unit that can be assembled in a factory or other location and then transported to a work site. The construction unit may be configured to include a space between spaced apart blocks into which a layer of an insulative material and a layer of a curable or settable material may be received.

20 Claims, 22 Drawing Sheets

WALL SYSTEM WITH MASONRY EXTERNAL SURFACE AND ASSOCIATED METHOD

BACKGROUND OF THE INVENTION

1. Field of the Invention

The present invention relates generally to in situ poured wall systems and associated methods and, more particularly, to such a wall system that includes at least one masonry external surface, or a substantially aesthetically completed external surface, along with an associated method.

2. Description of the Related Art

Poured wall systems and associated methods are well known in the relevant art. Such poured wall systems typically involve the use of some type of mold into which a curable or settable material is poured and which, after curing or setting, forms a finished wall. Such wall systems have been used successfully to form subterranean and/or above-ground walls of structures such as houses and the like and for other purposes.

One type of known wall system employs reusable form panels that are manually assembled to form a mold into which a material such as uncured concrete is poured and permitted to cure. After curing, the reusable form panels are manually removed, thus leaving a finished wall of the exemplary material concrete.

In the simplest form of the aforementioned system, the resulting wall is a solid block of the construction material which, in the example provided, is concrete, and may additionally include reinforcement structures such as so-called rebar extending therethrough. It is known, however, that concrete has relatively poor thermal insulative properties. Additionally, the labor involved in initially assembling and ultimately removing the reusable form panels can be significant. Moreover, the external appearance of a poured wall can be less than fully aesthetically pleasing. In this regard, it is noted that applicable building codes may require the covering of exposed concrete walls.

In an effort to overcome the thermal shortcomings of concrete walls, it has been known to add a layer of insulating material, such as a sheet of expanded polystyrene, to the wall by disposing the layer of insulating material against one of the form panels prior to pouring the uncured concrete into the space between the layer of insulating material and the other form panel. Again, however, the exposed layer of insulating material has been known to be aesthetically unsatisfactory.

A need thus exists for an improved wall system and associated method that provides at least one aesthetically pleasing external surface, that incorporates an insulative material that enhances the insulative character of the resulting wall, and/or that is relatively easy to use according to the associated method. Such a wall system and method may allow for the incorporation of one or more appropriate reinforcement structures.

Such an improved wall system and/or associated method may involve the use of blocks or other structures into which a curable or settable material such as uncured concrete can be poured to form an in situ wall, wherein the blocks each include a substantially aesthetically completed exterior surface. The substantially aesthetically completed exterior surfaces of the blocks or other structures may together provide a substantially aesthetically completed exterior surface for the wall.

Another type of known wall system employs blocks formed of an insulative material such as expanded polystyrene formed with a cavity extending therethrough. A large number of such blocks are assembled together such that the individual cavities thereof together combine to form a single coextensive cavity extending throughout the array of assembled blocks. The blocks including the coextensive cavity together form a mold into which a curable or settable material such as uncured concrete can be poured to form an in situ wall of which the original blocks of insulative material are an integral part. The resulting in situ wall includes external surfaces formed by the insulative material, which often are less than fully aesthetically pleasing.

It is thus desired to provide an improved wall system and associated method that provides a wall formed in situ that includes a relatively aesthetically pleasing external surface. Such an aesthetically pleasing external surface may be a masonry external surface.

SUMMARY OF THE INVENTION

These considerations and others are met by an improved wall system and associated method of the type described below. An improved wall system for forming a wall includes a plurality of blocks formed at least partially of a masonry material, a layer of an insulative material, and a layer of a curable or settable material interposed between the blocks and the layer of insulative material. The blocks may provide the wall with a masonry external surface or an exterior surface that is substantially aesthetically completed upon arrangement of the blocks and prior to the pouring of the layer of curable or settable material. The wall may include a plurality of ties extending between the blocks and the layer of insulative material to create a space between the blocks and the layer of insulative material into which the layer of curable or settable material may be poured. The ties may include flanges or tapered plugs that are cooperable with notches or slots formed in the blocks and may additionally include other flanges that are cooperable with the layer of insulative material. In an alternate embodiment of the present invention, ties may extend between a pair of blocks to form a construction unit that can be assembled in a factory or other location and then transported to a work site. The construction unit may be configured to include a space between spaced apart blocks into which a layer of an insulative material and a layer of a curable or settable material may be received. At least one of the aforementioned systems may include structures configured to support reinforcement members such as rebar, and such support structures may be movable to position the reinforcement members in desirable locations.

Accordingly, an aspect of the present invention is to provide an improved wall system that includes at least one aesthetically pleasing external surface such as a masonry external surface.

Another aspect of the present invention is to provide an improved wall system having at least one aesthetically pleasing external surface and including a layer of an insulative material.

Another aspect of the present invention is to provide an improved wall having a masonry external surface and including a plurality of blocks that are formed at least partially out of a masonry material.

Another aspect of the present invention is to provide an improved wall system that employs a plurality of assembled constructions units, each being formed of a pair of blocks formed at least partially of a masonry material and including at least a first tie extending between the blocks.

Another aspect of the present invention is to provide an improved assembled construction unit for use in constructing a wall, with the construction unit including a space between a pair of spaced apart blocks that can receive a quantity of a curable or settable material therein and that may additionally receive therein a layer of an insulative material.

Another aspect of the present invention is to provide an improved tie that can be used in conjunction with a layer of insulative material and a block that is at least partially manufactured out of a masonry material in order to construct an improved wall.

Another aspect of the present invention is to provide an improved wall system employing a plurality of blocks and a plurality of ties, the ties being mounted on the blocks to connect the blocks with other structures, and with the ties being substantially invisible from an external surface of the blocks.

Another aspect of the present invention is to provide an improved wall system including a number of blocks, with each block including a substantially aesthetically completed exterior surface, wherein such exterior surfaces of the blocks, when aligned with one another, provide a substantially aesthetically completed exterior surface for use in forming an in situ wall.

Another aspect of the present invention is to provide an improved wall system employing a number of blocks and a plurality of ties, with the blocks each being formed with a slot having a constricted throat, and with each tie including a tapered plug, with the plugs being cooperably receivable in the slots.

Another aspect of the present invention is to provide an improved wall system employing a plurality of blocks, a layer of an insulative material, and a plurality of ties, with the ties extending between the blocks and the layer of insulative material to create a coextensive space between the blocks and layer of insulative material, wherein the space can receive a settable material, and wherein the portion of each tie that extends through the space is of a greater area in the vertical direction than in the horizontal direction.

Another aspect of the present invention is to provide an improved method of forming a wall having a substantially aesthetically completed exterior surface by providing a number of blocks having substantially aesthetically completed exterior block surfaces which together form the substantially aesthetically completed exterior surface of the wall after the formation of an intermediate layer between the blocks and a layer of an insulative material.

Another aspect of the present invention is to provide an improved method of forming a wall by using a plurality of ties to mount at least a first layer of an insulative material to a plurality of blocks to provide a space between the layer of insulative material and the blocks, and by forming an intermediate layer in the space between the insulative material and the blocks.

Accordingly, an aspect of the present invention is to provide a wall, the general nature of which can be stated as including a first layer including a substantially aesthetically completed exterior surface, a second layer, a third layer interposed between the first and second layers, the third layer being a layer of a cementitious material formed between the first and second layers, and at least a first tie extending between the first and second layers.

In such a wall, the first layer includes a plurality of first blocks. Such a wall may also include at least one of the blocks being formed with at least a first receptacle, with the third layer being formed between the first and second layers and being received in at least a portion of the at least first receptacle.

Another aspect of the present invention is to provide a wall having a masonry external surface, in which the general nature of the wall can be stated as including a first layer formed at least partially of a masonry material, the first layer including the masonry external surface, a second layer formed of a second material, a third layer interposed between the first and second layers, and at least a first tie extending between the first and second layers.

In such a wall, the third layer may be one of a cured material and a set material formed between the first and second layers. Such a third layer may be formed of a masonry material.

Another aspect of the present invention is to provide a tie structured to extend between a first layer of material and a second layer of material for use in constructing a wall, the wall including the first layer, the second layer, and a third layer interposed between the first and second layers, in which the general nature of the tie can be stated as including a strut, the strut including a first face and a second face opposite one another, a pair of first flanges disposed on the strut and extending outwardly from the first face, the first flanges being substantially parallel with one another and spaced apart from one another, the first flanges being substantially semi-circular in shape and including an arcuate edge facing away from the first face, the first flanges being structured and arranged to be cooperable with the first layer, and a plurality of second flanges disposed on the strut and extending outwardly from the first face, the second flanges being substantially rectangular in shape, the second flanges being substantially parallel with one another and spaced apart from one another.

In such a tie, the strut may include a shank and a rib, with the rib being disposed on the shank, and with the first and second faces being defined on the shank, the rib extending between one of the first flanges and one of the second flanges. The rib may include a plurality of sockets formed therein, with the sockets being structured and arranged to receive a reinforcement member in one of the sockets depending upon the strengthening effect desired from the reinforcement member.

Another aspect of the present invention is to provide a tie structured to extend between a pair of members to form an assembled construction unit for use in constructing a wall, in which each of the members includes at least a first receptacle, and in which the wall includes at least the construction unit and a third layer interposed between the members, wherein the general nature of the tie can be stated as including a shank, a first leg structured to be received in the at least first receptacle of one of the members, a second leg structured to be received in the at least first receptacle of the other of the members, and a pair of caps, one of the caps being receivable on the first leg, the other of the caps being receivable on the second leg.

Another aspect of the present invention is to provide a tie structured to extend between a first layer of material and a second layer of material for use in constructing a wall, in which the wall includes the first layer, the second layer, and a third layer interposed between the first and second layers, wherein the general nature of the tie can be stated as including a strut, a tapered plug disposed at an end of the strut, the plug being structured and arranged to cooperate with a slot formed in the first layer and having a constricted throat, the strut including a first face and a second face opposite one another, and a pair of flanges disposed on the strut and extending outwardly from the first face, the first flanges being substantially parallel with one another and spaced apart from one another, the first flanges being structured and arranged to be cooperable with the second layer.

The plug may include a narrowed end, and may further include an abutment member disposed adjacent the narrowed end, with the abutment member being structured and arranged to engage a surface of the first layer adjacent the slot. The plug may include a stop, with the stop being oriented generally perpendicular to the abutment member, and with the stop being structured and arranged to limit movement of the plug with respect to the slot.

Another aspect of the present invention is to provide a construction unit for use in constructing a wall, in which the general nature of the construction unit can be stated as including a pair of blocks and a tie extending between the blocks, the tie retaining the pair of blocks substantially rigidly with respect to one another to provide a space between the blocks, and the wall unit being structured and arranged to receive a material in the space to form the wall.

The tie may include a shank and a pair of legs, with one of the legs being mounted to one of the blocks, and with the other of the legs being mounted to the other of the blocks. Additionally, each of the blocks may be formed with at least a first receptacle, with at least a portion of each of the legs being mounted in the at least first receptacles of the blocks.

Another aspect of the present invention is to provide a method of forming a wall having a substantially aesthetically completed exterior surface, in which the general nature of the method can be stated as including providing a plurality of blocks, each of the blocks being formed with at least a first receptacle and including a substantially aesthetically completed exterior block surface, providing a plurality of ties, providing at least a first sheet of insulative material, mounting the ties between the blocks and the at least first sheet of insulative material to form a space between the blocks and the at least first sheet of insulative material, aligning the substantially aesthetically completed exterior block surfaces with one another, and forming an intermediate layer in the space between the blocks and the at least first sheet of insulative material.

Said forming an intermediate layer may include receiving a quantity of a masonry material in the space between the blocks and the at least first sheet of insulative material and one of curing and setting the masonry material. Said forming an intermediate layer may also include receiving at least a portion of the intermediate layer in at least a portion of the at least first receptacle.

Said mounting the ties may include mounting a first set of ties below a first course of the blocks and mounting a second set of ties above the first course of blocks. Said mounting a second set of ties may include mounting an intermediate tie between a pair of adjacent blocks of the first course and mounting a central tie generally centrally on one of the blocks of the first course. Such a method may further include placing a second course of blocks atop the first course of blocks. Said placing a second course may include receiving at least a portion of the central tie in the at least first receptacle formed in each of a pair of adjacent blocks of the second course.

Another aspect of the present invention is to provide a method of forming a wall having a masonry external surface, in which the general nature of the method can be stated as including providing a plurality of masonry blocks, each of the masonry blocks being formed with at least a first receptacle, providing a plurality of ties, providing at least a first sheet of insulative material, mounting the ties between the masonry blocks and the at least first sheet of insulative material to form a space between the masonry blocks and the at least first sheet of insulative material, and forming an intermediate layer in the space between the masonry blocks and the at least first sheet of insulative material.

BRIEF DESCRIPTION OF THE DRAWINGS

A further understanding of the invention can be gained from the following Description of the Preferred Embodiments when read in conjunction with the accompanying drawings in which.

Similar numerals refer to similar parts throughout the specification.

DESCRIPTION OF THE PREFERRED EMBODIMENTS

As used herein, the term "masonry" and variations thereof shall refer to a broad variety of materials that can be used in construction applications, as well as other applications, of the type that may be used by a mason, and can include, for instance, brick or other clay constructions, stone, concrete, cement, cinder blocks, aerated concrete blocks, paver blocks, vitrified materials, and composite materials, as well as other materials, and can additionally include materials that are intended to simulate in some fashion any of the aforementioned materials. Moreover, the term "masonry" and variations thereof shall comprise materials that occur naturally as well as those materials that are, in whole or in part, man-made, and shall specifically include, among other materials, cementitious materials and other materials that are curable or settable and that may be either homogeneous or that include a plurality of discreet materials such as, for example, materials that include a binder and an aggregate, as well as other materials.

As used herein, the word "cementitious" and variations thereof shall refer to all materials that are at least partially formed of a cement material, such as Portland cement, whether or not used in conjunction with an aggregate material.

The expressions "settable" and "curable" and variations thereof shall refer to an aspect of materials that can undergo a change in a state of matter or other change of state such as characterized by a change in the viscosity thereof, a change in the hardness thereof, or a change in another material property under certain circumstances, and may refer to an aspect of, for instance, masonry materials, cementitious materials, thermosetting materials, thermoplastic materials, materials that harden upon the application of heat such as ceramics, and materials that harden or undergo a change in material properties in the presence of certain environmental materials such as air, water, and the like, as well as other materials. It is understood that the terms "settable" and "curable" and variations thereof may be used substantially interchangeably herein, it being noted that the two terms are not employed herein in an exclusive fashion, and rather that the use of either of the terms "settable" and "curable" and variations thereof generally shall include the other.

The term "poured" and variations thereof shall refer not only to materials that are liquid or semi-liquid in character, but also those materials that are granular, particulate, or can otherwise be moved using material handling equipment and methodologies that are understood in the relevant art.

Figure 1:
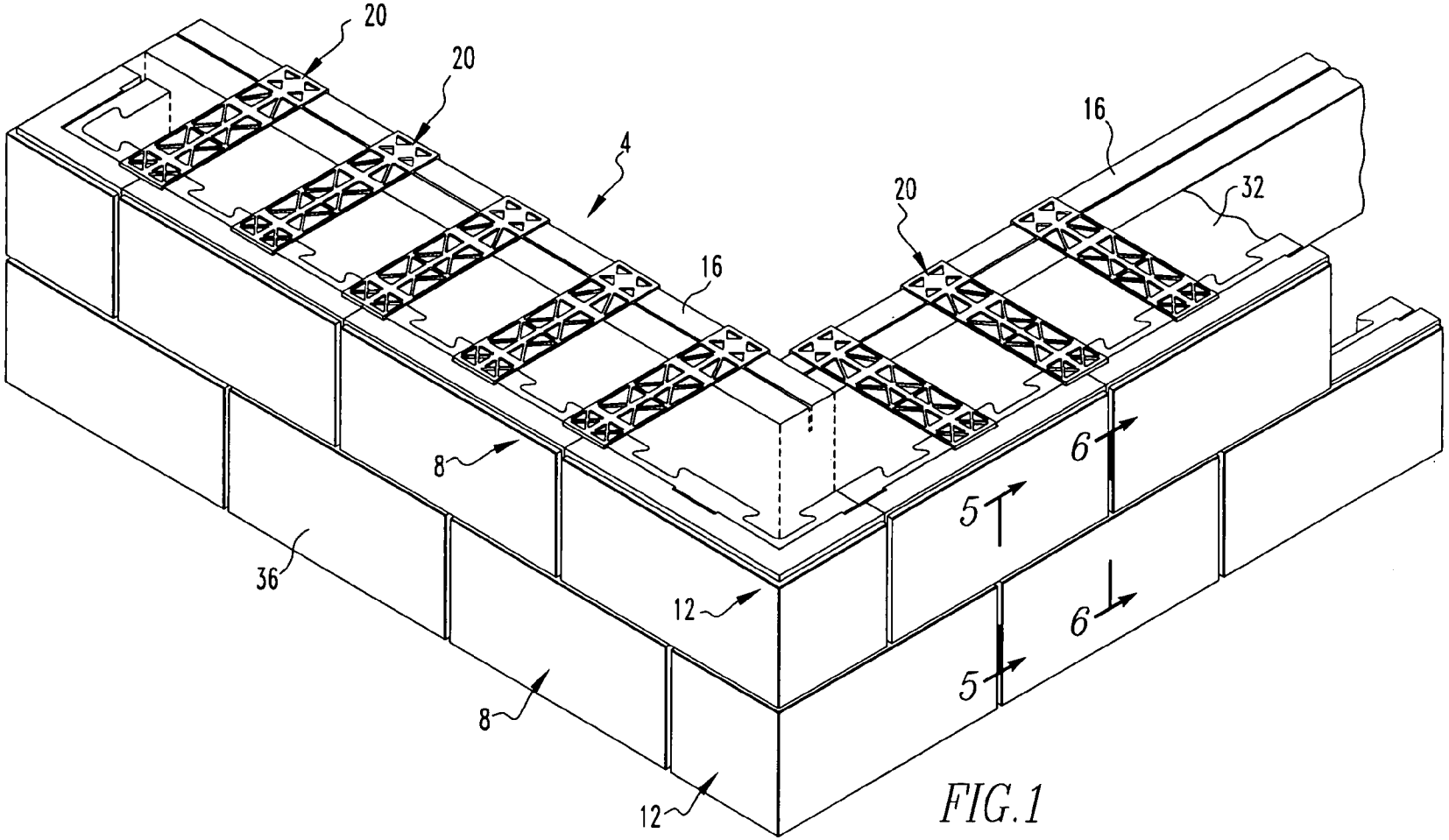
FIG. 1 is a perspective view of a wall in accordance with a first embodiment of the present invention.
Figure 2:
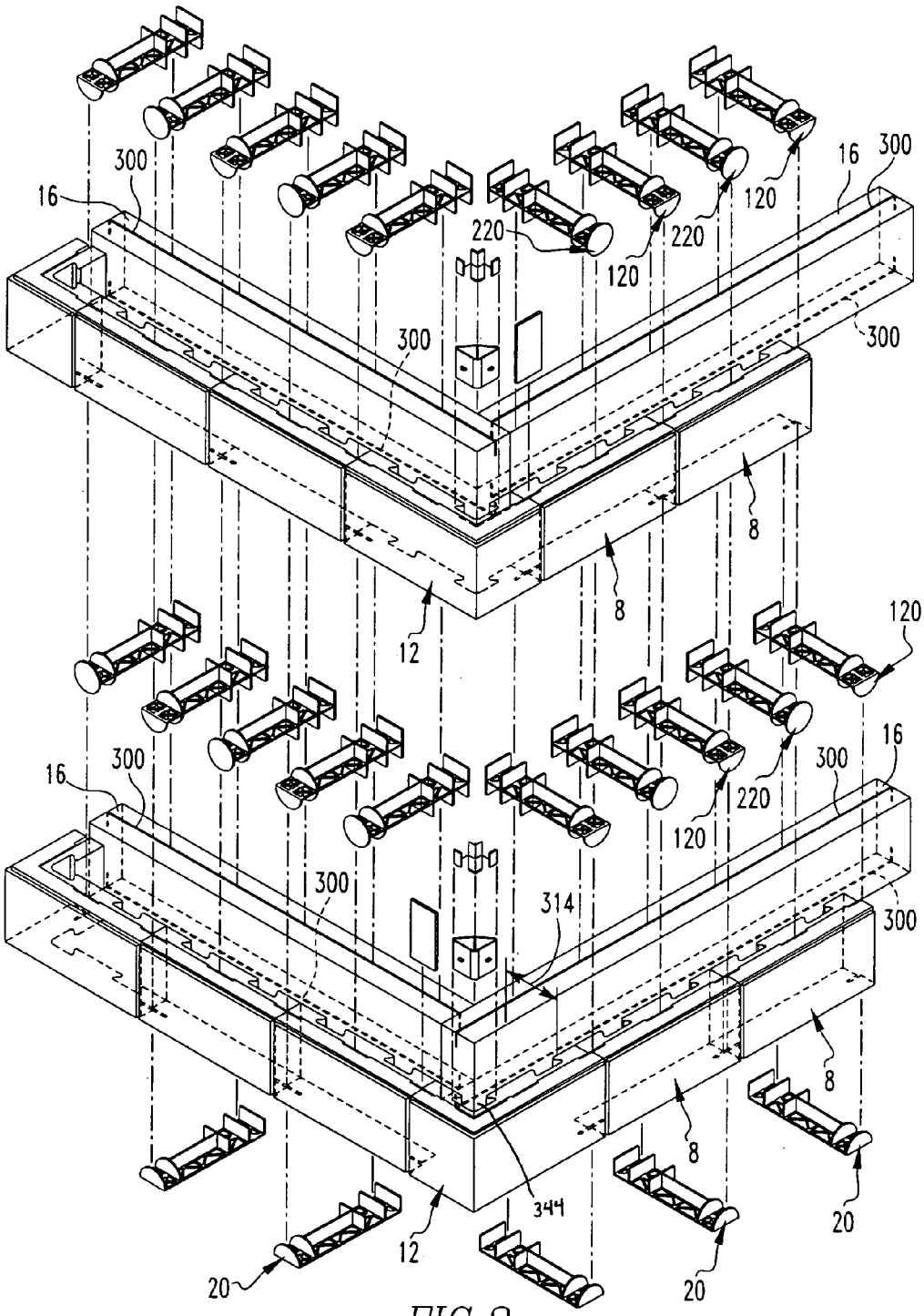
FIG. 2 is an exploded perspective view of a portion of a wall in accordance with the first embodiment of the present invention.

An improved wall 4 in accordance with a first embodiment of the present invention is indicated generally in FIG. 1. An exploded view of a wall system, which is a portion of a wall similar to the wall depicted in FIG. 1, is depicted generally in FIG. 2. As can be understood from FIGS. 1 and 2, the wall 4 is formed out of a plurality of blocks 8 and 12, at least a first insulation sheet 16, a plurality of ties 20, 120, and 220 that are employed to extend between the blocks 8 and 12 and the sheets of insulation 16, and a central layer 32 that is disposed generally between the blocks 8 and 12 and the insulation sheets 16.

The blocks 8 and 12 are constructed at least partially of a masonry material and particularly include a masonry external surface 36. The masonry external surface 36 substantially includes masonry materials and is configured to be aesthetically pleasing. Moreover, the masonry external surface 36 is substantially aesthetically completed, meaning that the external surface 36 is in a form wherein substantially no additional work is required to be performed on the external surface 36 in order to complete the final construction of the wall 4. Further in this regard, when the external surfaces 36 of the blocks 8 and 12 are aligned with one another, such as prior to the application of the central layer 32, since the external surfaces 36 are substantially aesthetically completed, the combination of such external surfaces 36 results in an overall exterior surface that is likewise substantially aesthetically completed. In other words, the aligned external surfaces 36 will require substantially no additional aesthetically-oriented work pursuant to completion of the wall 4. For instance, it may be desirable to apply a small quantity of mortar or other adhesive or bonding material to various joints depending upon the desired final visual effect, which is an extremely minor task when considered in relation to the scope of the project of building the wall 4. While the substantially aesthetically completed external surfaces 36 are described herein as being of a masonry configuration, it should be understood that such a masonry aspect is exemplary and that the substantially aesthetically completed exterior surfaces could be of numerous aesthetically pleasing configurations of different materials, such as wood, metal, and the like.

The masonry external surfaces 36 of the blocks 8 and 12 together provide the wall 4 with an overall masonry external surface that is visible from the exterior of the wall 4. As can be seen from FIGS. 1 and 2, the blocks 8 are generally of a solid rectangular configuration, while the blocks 12 are of a generally L-shaped solid configuration. It is understood that blocks of other shapes may be employed in conjunction with the method and apparatus of the present invention. The blocks 8 will be described in further detail throughout, it being understood, however, that the blocks 12 are substantially similar, having many of the same features, and thus do not require further elaboration.

Figure 3A:
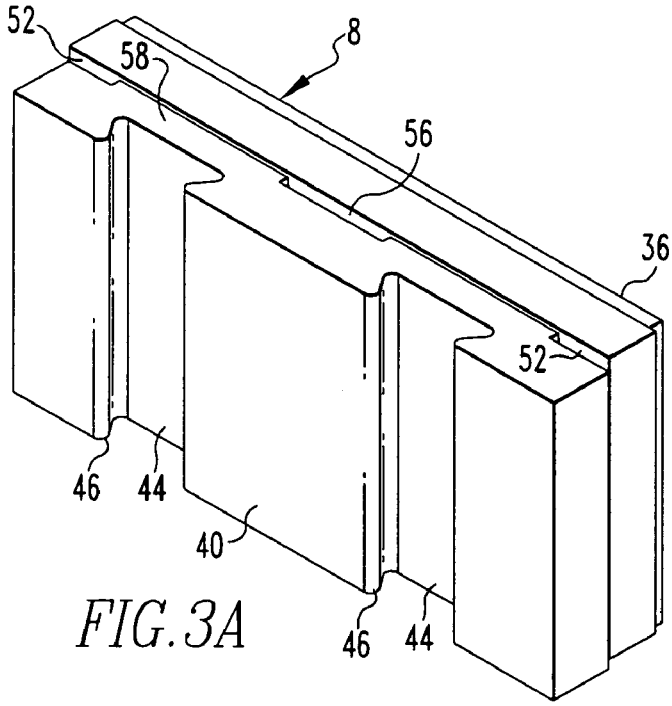
FIG. 3A is an enlarged perspective view of a block that can be employed in conjunction with the present invention.
Figure 3B:
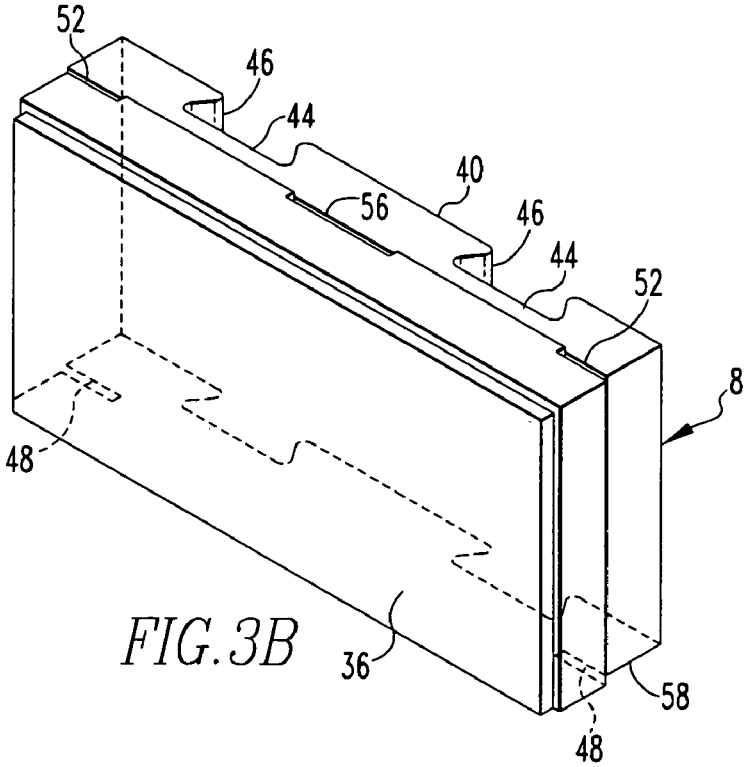
FIG. 3B is another enlarged perspective view of the block.

As is best shown in FIGS. 3A and 3B, the blocks 8 include an internal surface 40 opposite the masonry external surface 36, and further include a pair of elongated slots 44 formed on the internal surface 40. The slots 44 are each depicted as being a receptacle having a generally keystone-type cross-section or as having a constricted throat 46, although other cross-sections can be employed without departing from the concept of the present invention.

As is further shown in FIGS. 3A and 3B, each block 8 includes a pair of lower lateral notches 48 in the lower corners thereof, a pair of upper lateral notches 52 in the upper corners thereof, as well as an upper central notch 56 disposed substantially midway between the slots 44. As used herein, the terms "upper" and "lower" and variations thereof are intended to be used without limitation. The lower and upper lateral notches 48 and 52 and the upper central notch 56 all extend slightly into the interior of the block 8 from the exterior thereof and are oriented substantially parallel with and spaced from the masonry external surface 36, although other orientations can be employed without departing from the concept of the present invention. While the upper lateral notch 52 of any given side of the block 8 is separate from the lower lateral notch 48 on the same side, it is understood that in other embodiments (not shown) the lower and upper lateral notches 48 and 52 of any given side of one of the blocks 8 could be comprised by a single notch extending between the upper and lower ends of the block 8.

Each insulation sheet 16 is an elongated rectangular solid sheet of an insulative material, meaning that it is relatively resistant to the transmission of heat, particularly as compared with the material out of which the blocks 8 are manufactured. An exemplary insulative material out of which the insulation sheets 16 can be manufactured is expanded polystyrene, although other materials may be appropriate depending upon the specific needs of the particular application. For reasons that will be set forth more fully below, each insulation sheet 16 is, in the exemplary embodiment depicted herein, of substantially the same height as the blocks 8, and each includes a pair of elongated slits 300, the slits 300 being on opposed surfaces. As will be set forth in greater detail below, the slits 300 are employed for mounting the insulation sheets 16 on the ties 20, 120, and 220. For reasons of efficiency, the insulation sheets 16 may be of a substantially greater length than the blocks 8, although the insulation sheets 16 could be of smaller sizes depending upon the specific needs of the particular application.

Figure 4:
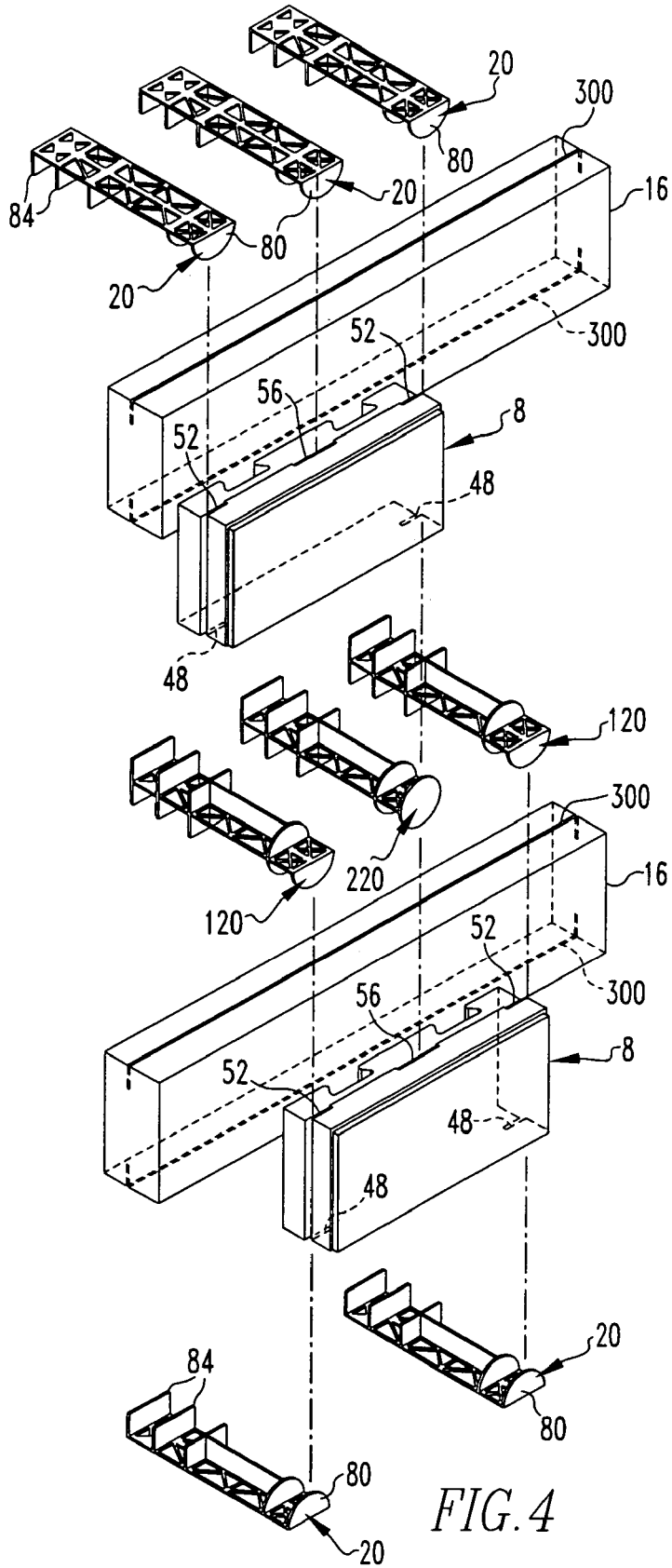
FIG. 4 is an exploded perspective view of a portion of the wall of FIG. 1.
Figure 9A:
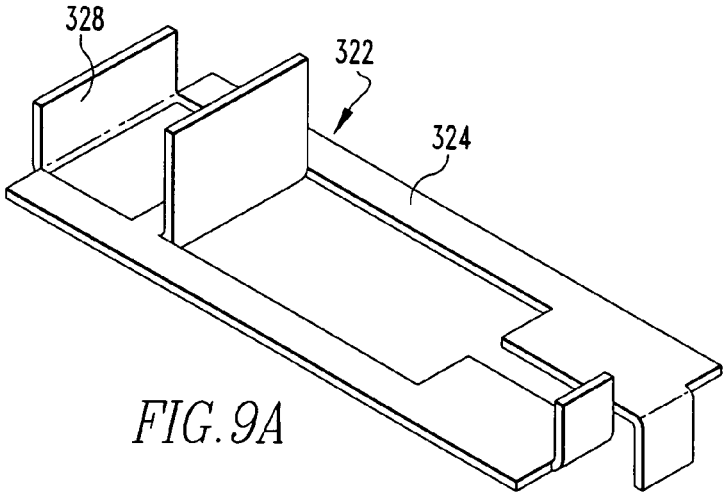
FIG. 9A is a perspective view of the supplemental support member of FIG. 5A.
Figure 7:
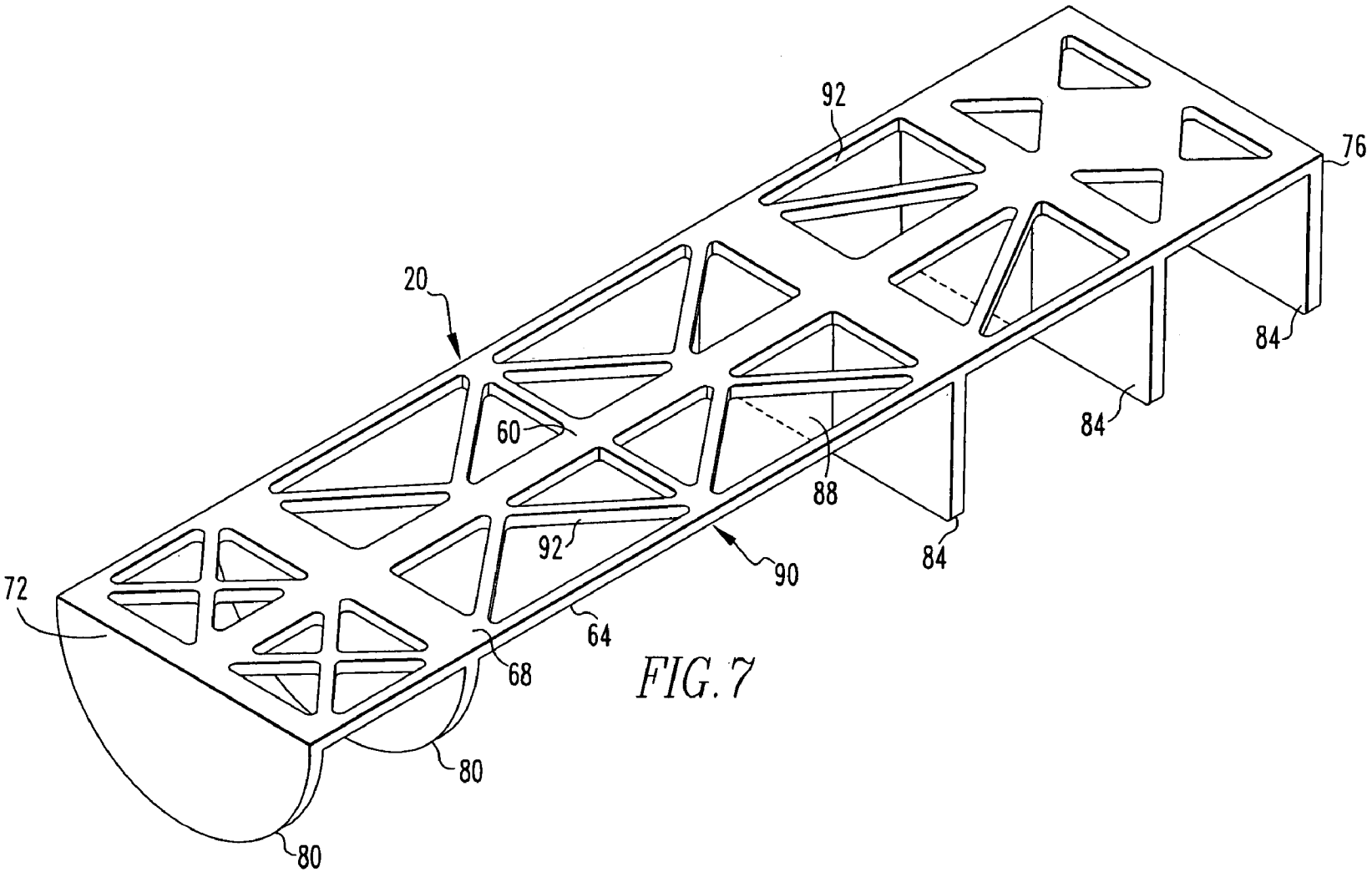
FIG. 7 is a perspective view of a tie in accordance with the first embodiment.
Figure 8:
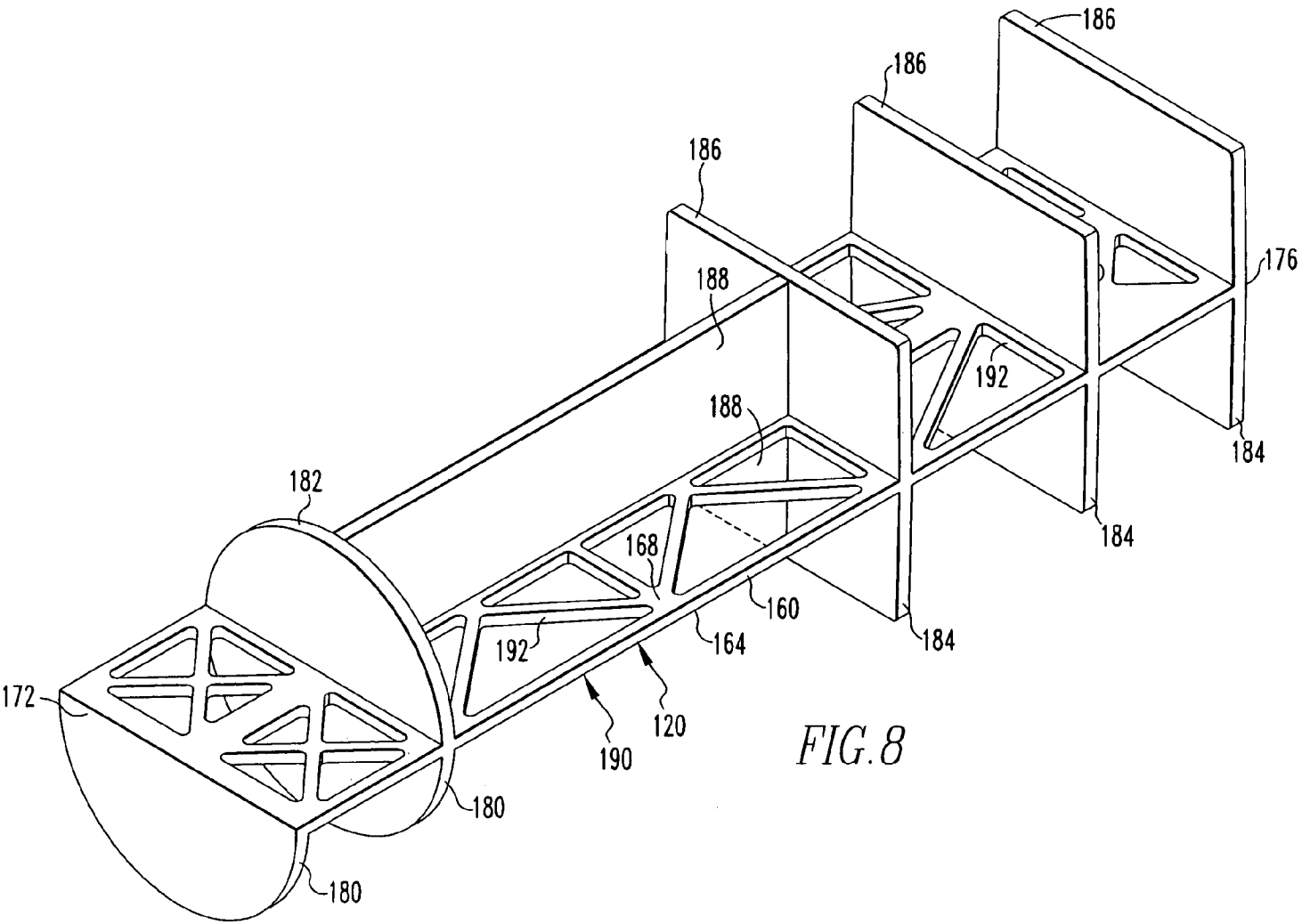
FIG. 8 is a perspective view of another tie in accordance with the first embodiment.
Figure 9:
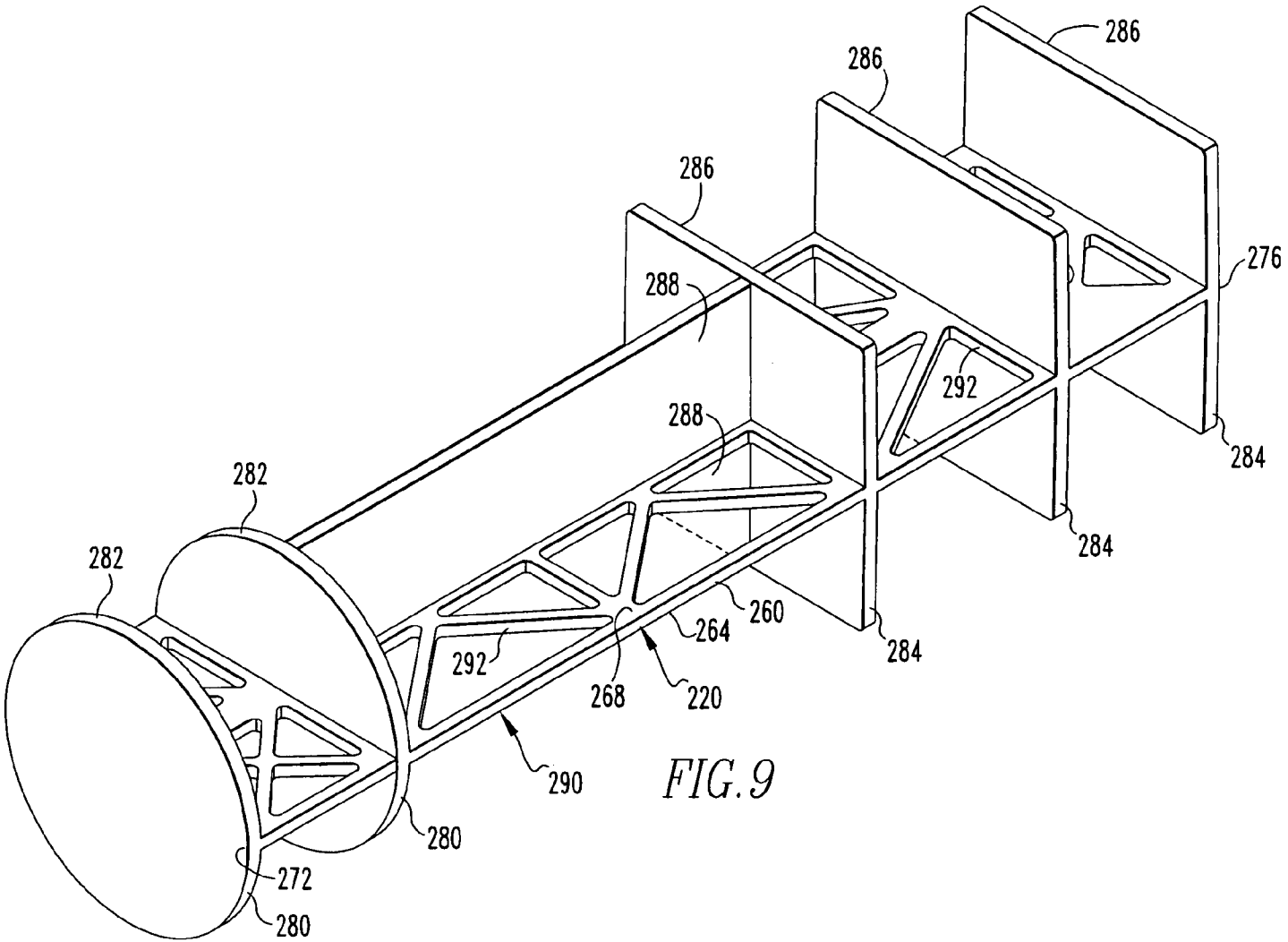
FIG. 9 is a perspective view of yet another tie in accordance with the first embodiment.

As can be understood from FIGS. 7-9, the ties 20, 120, and 220 are similar to one another, yet are different. The ties 20, 120, and 220 are particularly depicted in FIG. 4 in connection with a pair of the blocks 8 and a pair of the insulation sheets 16. The ties 20, 120, and 220 are mounted variously in the lower and upper lateral notches 48 and 52 and the upper central notches 56 in order to retain the insulation sheets 16 in a given position with respect to the blocks 8, as well as for other purposes.

As is best shown in FIG. 7, the tie 20 includes a generally planar shank 60 having a first face 64 and a second face 68 opposite one another, as well as having a first end 72 and a second end 76 opposite one another. The tie 20 additionally includes a plurality of substantially semi-circular first flanges 80 and a plurality of rectangular second flanges 84 protruding outwardly and substantially perpendicularly from the first face 64. Each of the first flanges 80 includes an arcuate edge that faces substantially away from the first face 64 of the shank 60.

The first flanges 80 are substantially parallel with one another and spaced apart, and are substantially free of structures extending therebetween apart from the shank 60. The second flanges 84 are substantially parallel and spaced apart from one another and are substantially free of structures extending therebetween apart from the shank 60. A rib 88 extends between the first flange 80 and the second flange 84 that are closest to one another, with the rib 88 being oriented substantially mutually orthogonal to the shank 60 and the first and second flanges 80 and 84. The rib 88 and the shank 60 together form a strut 90 that carries the first and second flanges 80 and 84 and provides rigidity to the tie 20.

The shank 60 is formed with a plurality of openings 92 that permit the material of the central layer 32 to be received therein. The openings 92 are also employed for other purposes, as will be set forth more fully below.

As is best shown in FIG. 8, the tie 120 is similar to the tie 20 in that it includes a shank 160 having opposite first and second faces 164 and 168 and opposite first and second ends 172 and 176, and further includes a pair of substantially semi-circular first flanges 180, and a plurality of rectangular second flanges 184. It is noted, however, that the tie 120 additionally includes a substantially semi-circular first flange extension 182 extending substantially perpendicularly outwardly from the second face 168 and that is connected with and is substantially coplanar with the first flange 180 that is spaced furthest from the first end 172. The tie 120 additionally includes a plurality of rectangular second flange extensions 186 extending substantially perpendicularly outward from the second face 168 and that are connected with and substantially coplanar with the second flanges 184. The tie 120 includes a pair of ribs 188, one of the ribs extending between the first and second flanges 180 and 184 that are closest to one another, and the other of the ribs 188 extending between the first flange extension 182 and the second flange extension 186 closest thereto. The ribs 188 are substantially coplanar. The shank 160 is similarly formed with a plurality of openings 192. The shank 160 and the ribs 188 together form a strut 190.

As is best shown in FIG. 9, the ties 220 are similar to the ties 120 in that they include a shank 260, opposite first and second faces 264 and 268, and opposite first and second ends 272 and 276. The ties 220 likewise also include a plurality of second flanges 284 that each include a second flange extension 286. The tie 220 is different, however, in that each of the semi-circular first flanges 280 includes a semi-circular first flange extension 282 connected therewith and substantially coplanar therewith. The ties 220 similarly each include a pair of ribs 288 and plurality of openings 292. The shank 260 and the ribs 288 together form a strut 290.

Again referring to FIGS. 1, 2, 4 and 7, it can be seen that the first flange 80 nearest the first end 72 of each tie 20 is received in one of the lower lateral notches 48 of the blocks 8. Specifically, it can be seen that any such given first flange 80 is disposed in the adjacent lower lateral notches 48 of a pair of adjoining blocks 8. The ties 20 are employed at junctions between the blocks 8 of the lower-most course of the blocks 8 of the wall 4 and are interposed generally between the blocks 8 of the first course and the footer (not shown) or other structure upon which the wall 4 is constructed.

The ties 120 and 220 are employed between vertically adjacent courses of blocks. As can be understood from FIGS. 2 and 4, the first flange 180 adjacent the first end 172 of each tie 120 is received in an adjacent pair of upper lateral notches 52 of a pair of adjoining blocks 8. As can be further be seen in FIGS. 2 and 4, the first flange 280 adjacent the first end 272 of each tie 220 is received in the upper central notch 56 of the blocks 8. The corresponding first flange extension 282 adjacent the first end 272 protrudes upwardly from the corresponding upper central notch 56. It can be understood, however, that such protruding first flange extension 282 is received in the adjacent lower lateral notches 48 of a pair of adjoining blocks 8. Such positional relationships are more clearly depicted in FIGS. 5 and 6.

Figure 5:
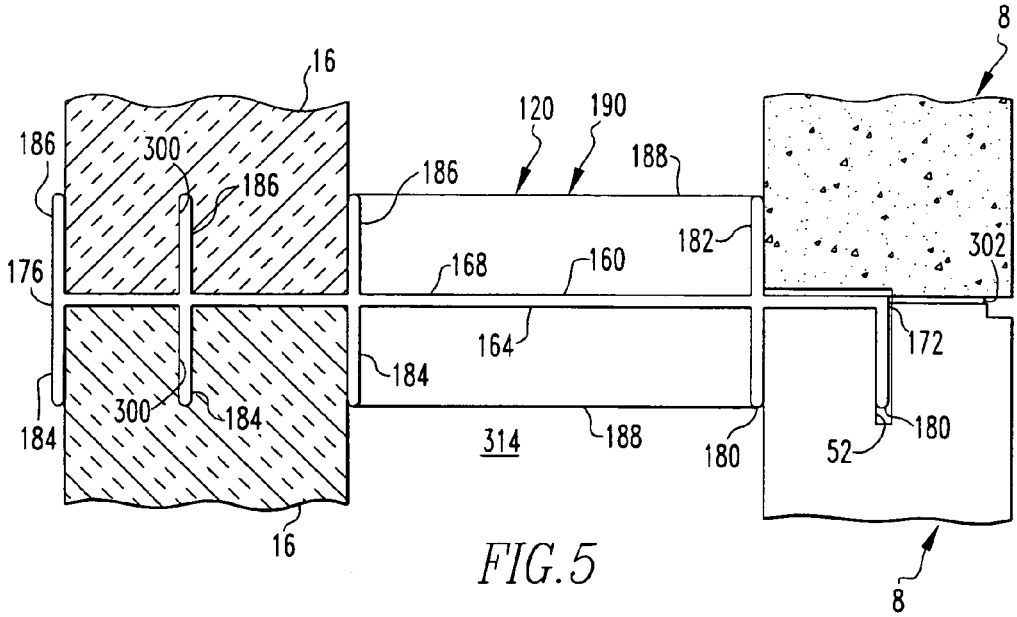
FIG. 5 is a sectional view as taken along line 5-5 of FIG. 1.
Figure 6:
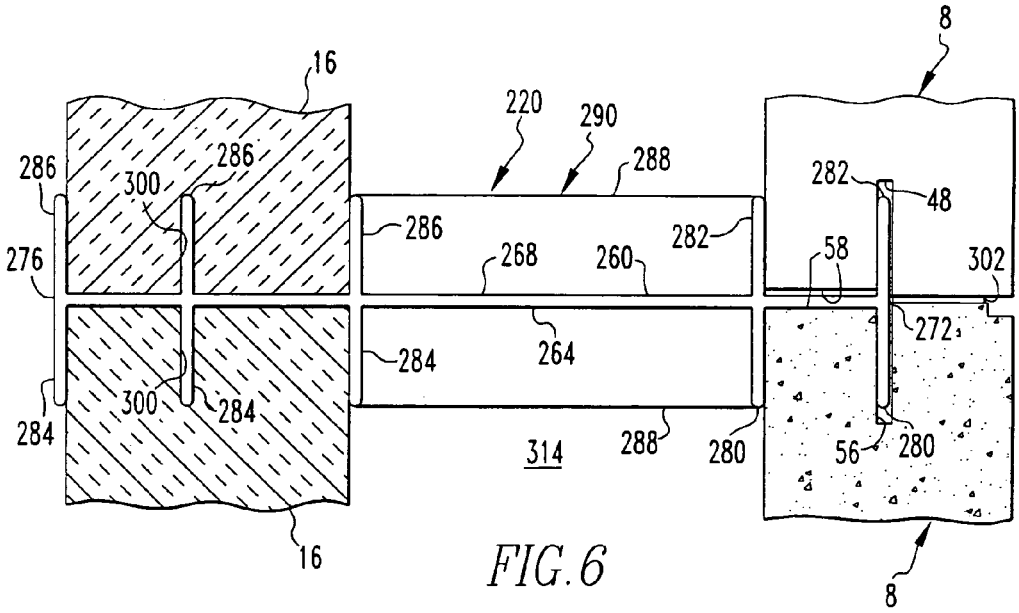
FIG. 6 is a sectional view as taken along line 6-6 of FIG. 1.

It can further be seen from FIGS. 5 and 6 that the ties 120 and 220 advantageously are substantially invisible when viewed from the masonry exterior surface 36 of the blocks 8. This is due to various surfaces of the blocks 8 being recessed, as well as due to the fact that an appropriate mortar 302 or other sealant may be employed between adjacent blocks. It can be understood that the ties 20 are similarly substantially invisible from the masonry exterior surface 36 for the same reasons.

As can further be understood from FIGS. 5, 6, and 7, the insulation sheet 16 is received between the second flanges 84, 184, and 284 and the second flange extensions 186 and 286 of vertically spaced ties 20, 120, and 220. As is shown in FIGS. 5 and 6, the centrally disposed second flanges 84, 184, and 284 of the ties 20, 120, and 220 or the opposed second flange extensions 186 and 286 of the ties 120 and 220 are received in the slits 300. It is understood, however, that in other embodiments of the present invention, the second flanges 84, 184, and. 284 and the second flange extensions 186 or 286 that are adjacent the second ends 76, 176, and 276 could be received in the slits 300. In such an embodiment, the insulation sheets 16 would be spaced generally farther away from the blocks 8 than is depicted generally in FIGS. 5 and 6, with the result that the central layer 32 would be correspondingly thicker, thereby resulting in a correspondingly thicker wall 4.

After the blocks 8 and 12 are connected with the insulation sheets 16 by mounting the ties 20, 120, and 220 therebetween, a space 314 exists between the blocks 8 and 12 and the insulation sheets 16. It is into this space 314 that the material of the second layer 32 is received in order to form the central layer 32 between the blocks 8 and 12 and the insulation sheets 16.

Prior to receiving the material of the central layer 32 in the space 314, however, it may be desirable to receive a corner tie into a corner slot 344 of the blocks 12, which extends between vertically spaced blocks 12. It may also be desirable to receive a spanning tie between an adjacent pair of upper lateral notches 52 of adjoining blocks 8 in a location, as appropriate, where none of the ties 20, 120, or 220 could be attached due to the configuration of the insulation sheets 16.

Once the blocks 8 and 12, the insulation sheets 16, the ties 20, 120, and 220, the corner ties, and the spanning ties have been assembled together to define the space 314, in the aforementioned fashion, the material that forms the central layer 32 can be received in the space 314 and permitted to form the central layer 32. In this regard, it is understood that the central layer 32 likely will be a curable or settable material such as, for example, uncured concrete or other cementitious material, although it is understood that other materials may be appropriate depending upon the specific needs of the particular application.

In curing or setting, the material that forms the central layer 32 is received in and cures in the slots 44 and 344 of the blocks 8 and 12, thus securing the central layer 32 to the blocks 8 and 12. The material of the central layer 32 can also flow into and through the openings 92, 192, and 292 of the ties 20, 120, and 220, to secure the ties 20, 120, and 220 in fixed relation with respect to the central layer 32. While not specifically depicted in the accompanying figures, the openings 92, 192, and 292, can receive reinforcement members such as rebar therein which, upon the curing or the setting of the material that forms the central layer 32 will be held in fixed relation to the various components of the wall 4 and will provide additional structural support to the wall 4 within the central layer 32.

It can be understood from FIG. 1 that the wall 4 includes a plurality of the ties 20 along the upper surface of the uppermost course of blocks 8 and 12. Specifically, the first flanges 80 adjacent the first ends 72 are received in both the upper central notches 56 as well as in the pairs of adjacent upper lateral notches 52 of adjoining blocks 8 and 12. Moreover, the second flanges 84 are received on the insulation sheets 16. Such ties 20 thus include no structures which protrude vertically above the blocks 8 and 12 of the uppermost course of blocks 8 and 12, which permits the wall have to an aesthetically pleasing appearance, and also permits additional structures to be built on the uppermost surface of the wall 4 without interference by the ties 20.

After the material of the central layer 32 has cured or set, the wall 4 is substantially completed. The masonry external surfaces 36 of the blocks 8 and 12 together form an aesthetically pleasing masonry exterior surface of the wall 4 from which the ties 20, 120, and 220 are substantially invisible. Since the second flanges 84, 184, and 284 and the second flange extensions 186 and 286 adjacent the second ends 76, 176, and 276 protrude outwardly slightly from the surfaces of the insulation sheets 16 opposite the central layer 32, such portions of the ties 20, 120, and 220 can be employed to receive screws or other fasteners during the installation of sheet rock or other wall structures onto the insulation sheets 16. The ties 20, 120, and 220 thus facilitate the attachment of an aesthetically pleasing structure or surface to the insulation sheets 16 if desirable.

Figure 5A:
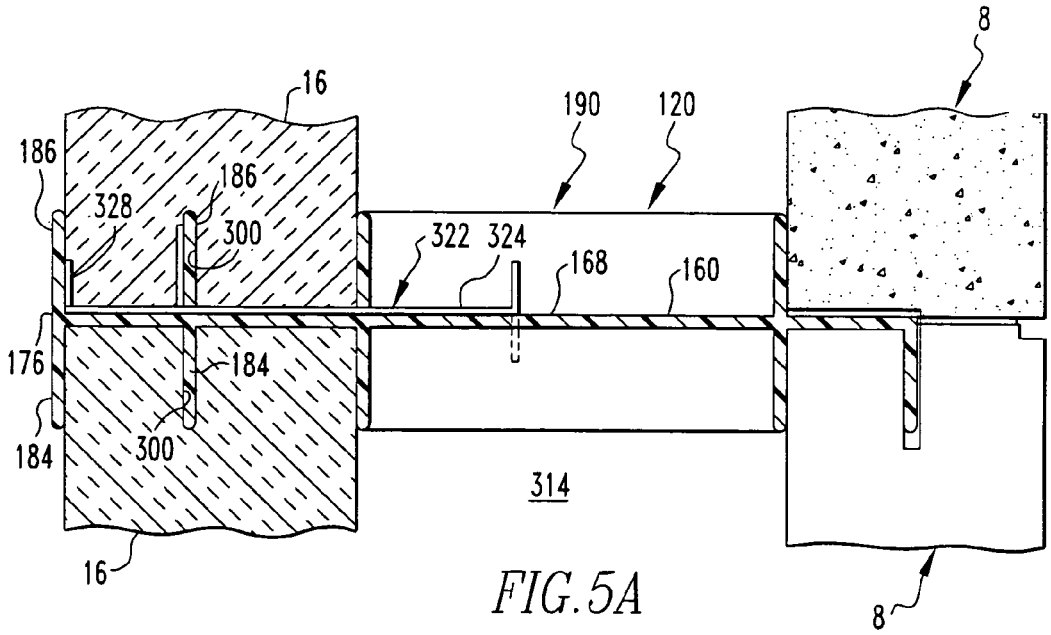
FIG. 5A is a view similar to FIG. 5, except additionally including a supplemental support member that may be used in conjunction with the first embodiment.

Further in this regard, it may be desirable to provide a supplemental support member 322 (FIG. 9*a*) on one or more of the ties 120 or 220, as is shown generally in FIG. 5A. The supplemental support member 322 includes a base 324 and fastening plate 328 that is disposed adjacent one of the second flanges 184 or 284 or second flange extensions 186 or 286 of the ties 120 or 220. Such supplemental support member 322 typically will be manufactured out of a sheet of metal and provide an additional backing structure for receiving screws or other fasteners therethrough for purposes of mounting sheet rock and the like to the insulation sheets 16, and for other purposes.

Figure 10:
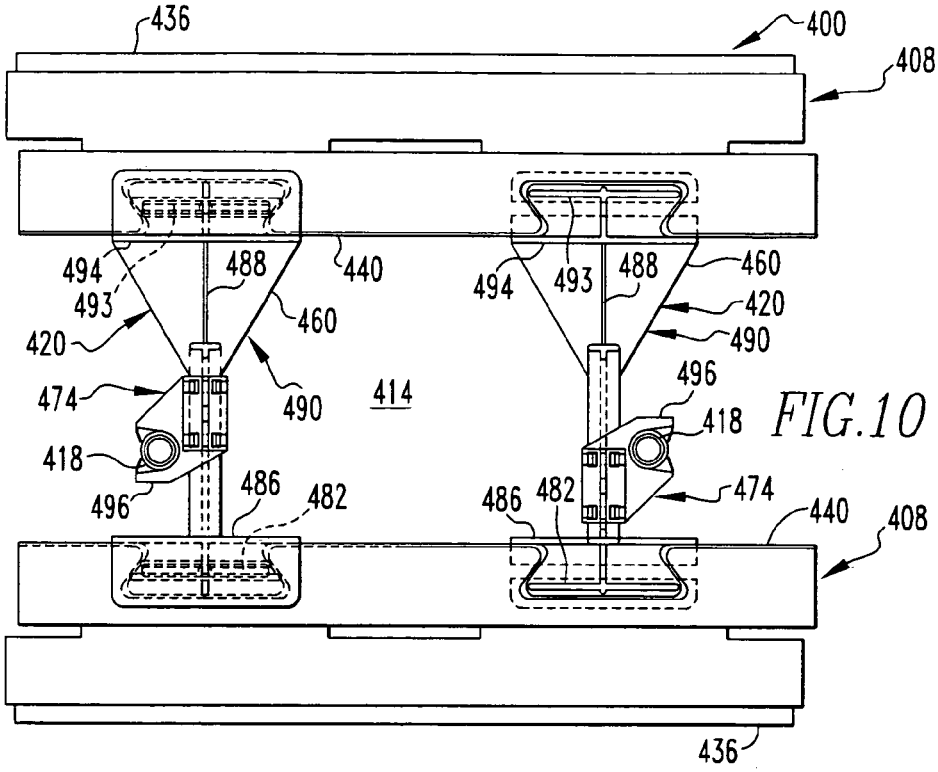
FIG. 10 is a top plan view of a construction unit in accordance with a second embodiment of the present invention.
Figure 11:
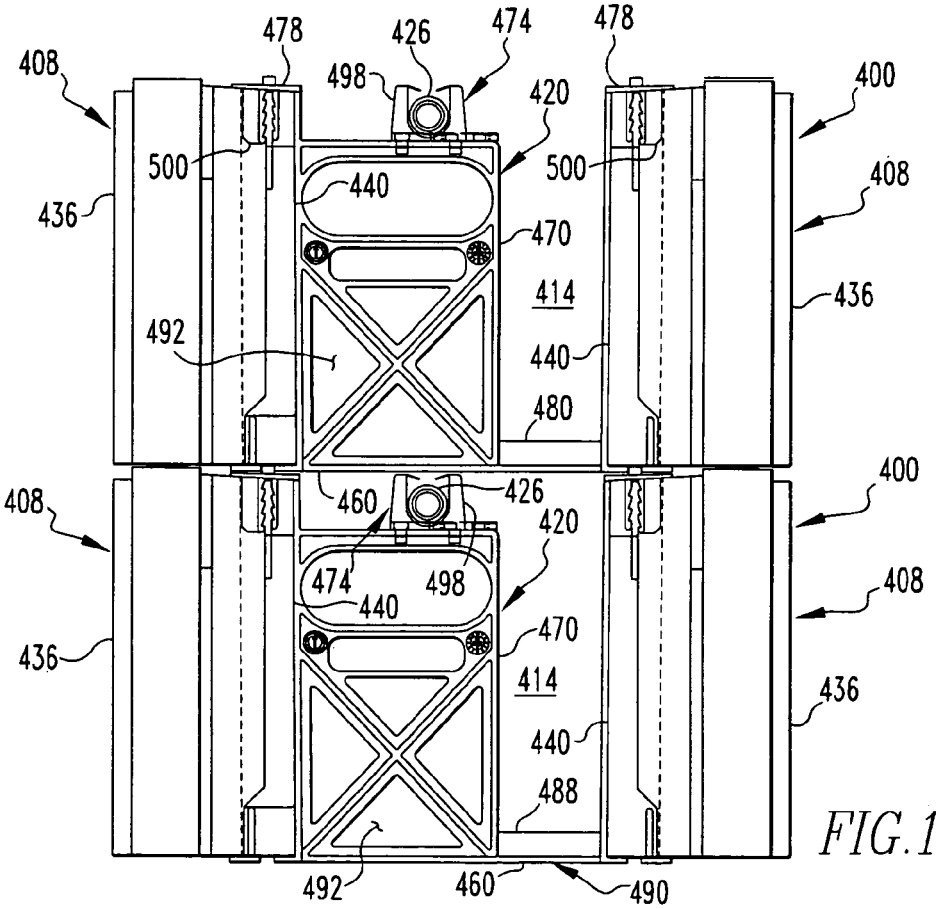
FIG. 11 is a side elevational view of a pair of the construction units stacked vertically.
Figure 12:
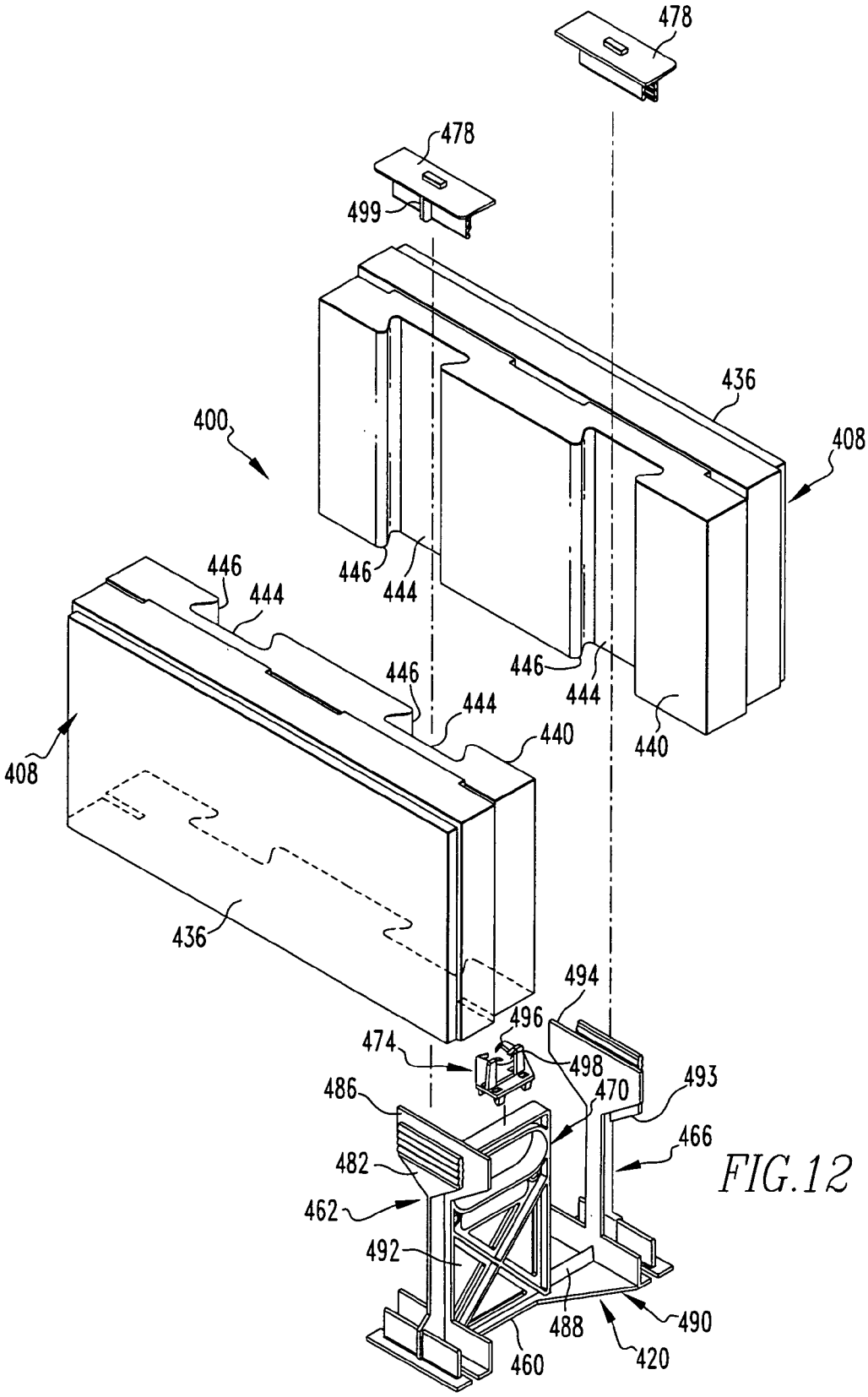
FIG. 12 is an exploded perspective view of the construction unit.
Figure 14:
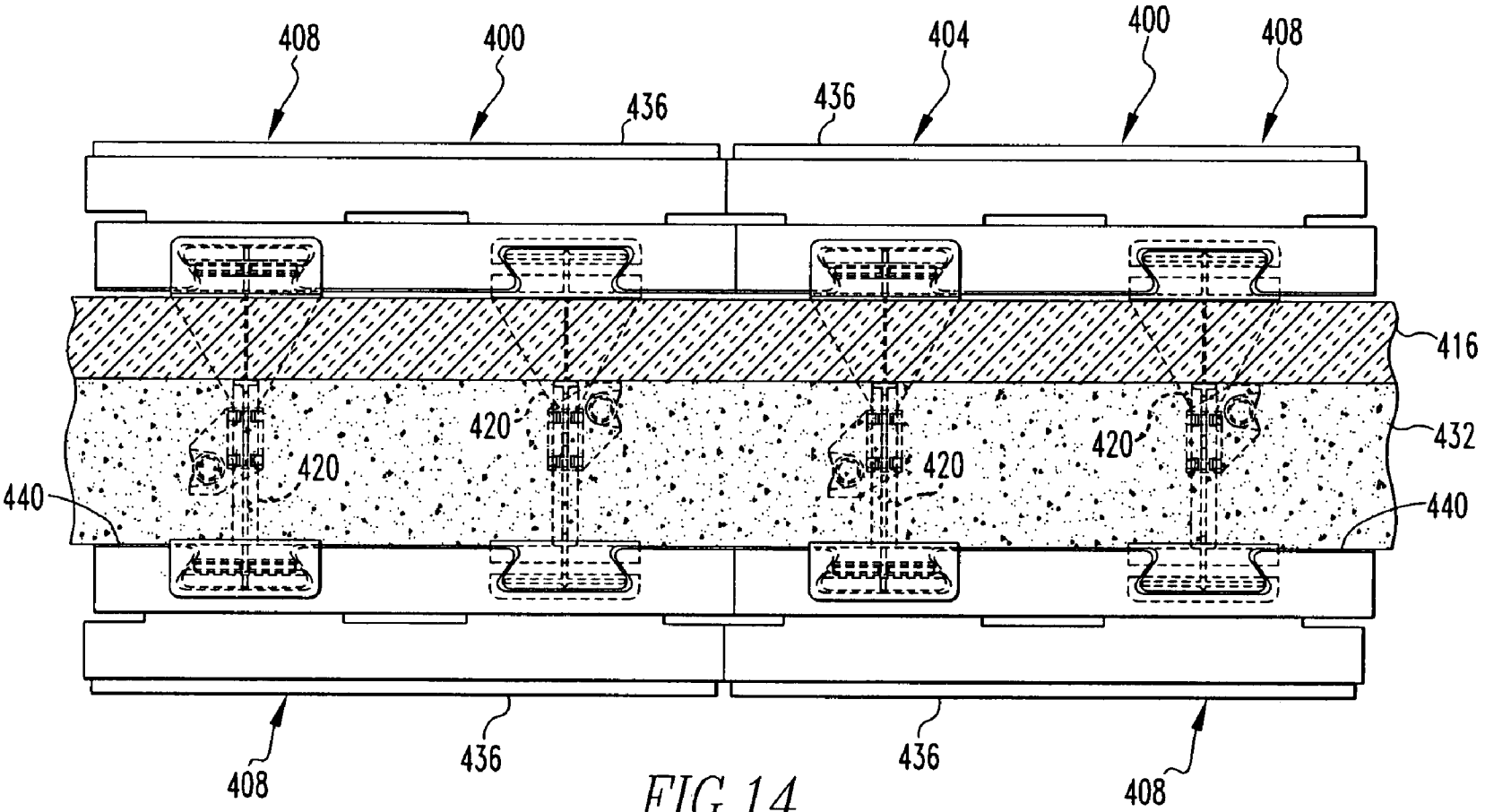
FIG. 14 is a top plan view of a portion of a wall employing the construction units in accordance with the second embodiment.
Figure 15:
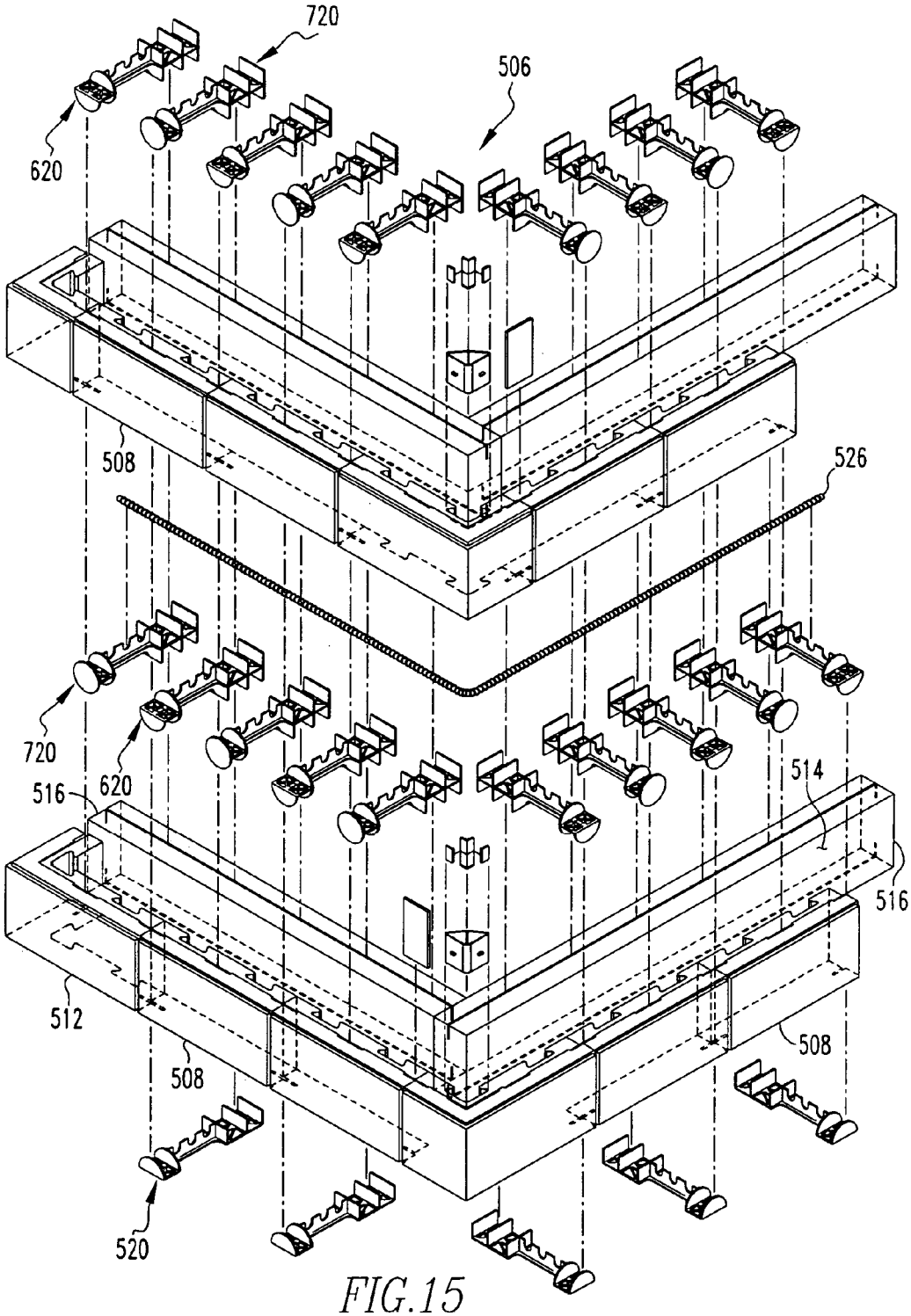
FIG. 15 is an exploded perspective view of a wall system constituting a portion of a wall in accordance with a third embodiment of the present invention.
Figure 16:
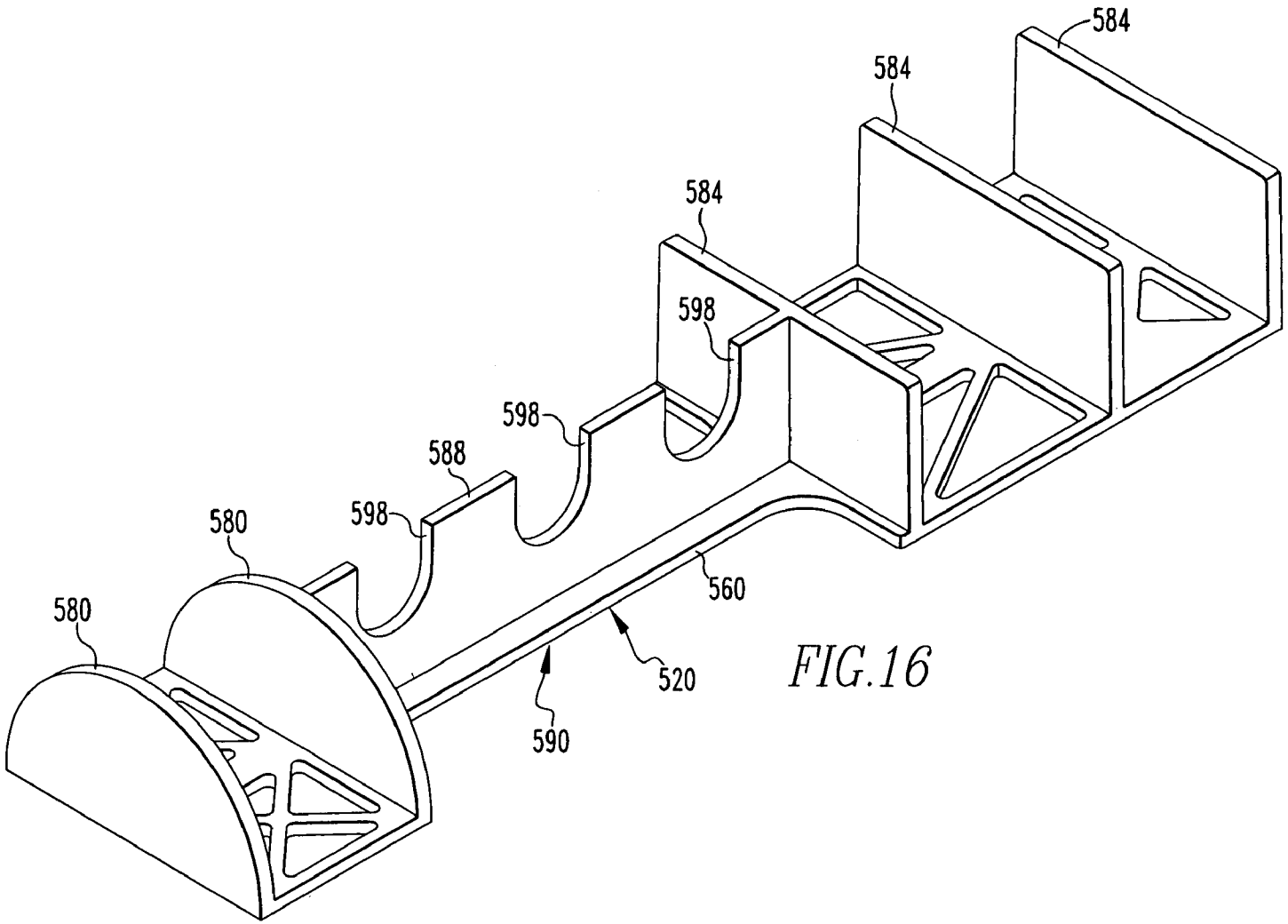
FIG. 16 is a perspective view of a tie in accordance with the third embodiment.

A construction unit 400 in accordance with another aspect of the present invention is indicated generally in FIGS. 10-12 and can be employed to construct a wall 404, as is depicted generally in FIG. 14. Each construction unit 400 includes a pair of blocks 408 and a pair of tie assemblies 420, with the tie assemblies 420 extending between the blocks 408. The construction units 400 can advantageously be manufactured at a manufacturing facility or other off-site utility, transported to the work site, and assembled at the construction site in the process of forming the wall 404.

As can be understood from FIGS. 10-14, the construction units 400 are configured such that the blocks 408 are spaced apart from one another to define a space 414 therebetween. As can be understood from FIGS. 13 and 14, the wall 404 includes a plurality of the blocks 408 assembled together, at least a first insulation sheet 416, and a central layer 432. In the depicted embodiment, the insulation sheets 416 are disposed in the space 414 adjacent one set of vertically aligned blocks 408, and the central layer 432 is formed in the portion of the space 414 between the insulation sheets 416 and the other set of vertically aligned blocks 408.

The insulation sheets 416 are substantially similar to the insulation sheets 16. Similarly, the material of the central layer 432 can be substantially similar to the material of the central layer 32.

Each of the blocks 408 includes a masonry external surface 436 and an internal surface 440 opposite one another. The internal surface 440 is formed with a pair of elongated slots 444 formed thereon. Each slot 444 is a receptacle having a constricted throat 446 (FIG. 12). The insulation sheets 416 are disposed against the internal surfaces 440 of certain of the blocks 408, and the central layer 432 is disposed against the internal surface 440 of other of the blocks 408.

As is best shown in FIG. 12, each tie assembly 420 includes a shank 460, a first clamp 462, a second clamp 466, a support 470, a saddle 474, and a pair of caps 478. The shank 460 is a generally planar member upon which the first and second clamps 462 and 466 are disposed. The first clamp 462 includes an inner plate 482 and an outer plate 486 that extend substantially perpendicularly away from the shank 460. Similarly, the second clamp 466 includes an inner plate 493 and an outer plate 494 that extend substantially perpendicularly away from the shank 460.

As can be best understood from FIG. 10, the inner plates 482 and 493 are received in the opposing slots 444 of the pair of blocks 408 of the construction unit 400. The outer plates 486 and 494 are disposed against the internal surfaces 440 in the vicinity of the slots 444. The caps 478 include a plurality of ridges that are engageable with corresponding ridges formed on the free ends of the inner plates 482 and 493 in order to retain the caps 478 thereon. The caps 478 each include a tab 499 that engages the base of the slot 444 when the cap 478 is mounted on the inner plate 482 or 493. The combination of the tabs 499 on the caps 478 and the shank 460 tightly retain the blocks 408 between the caps 478 and the shank 460, thus retaining the blocks 408 in fixed relationship to one another to form the construction unit 400.

The support 470 is mounted to the shank 460 and the first clamp 462 and is formed to include a plurality of openings 492 through which the material of the central layer 432 can be received during formation of the wall 404. The support 470 also includes a rib 488 mounted on the shank 460 and connected with the second clamp 466. The shank 460 and the rib 488 together form a strut 490. The insulation sheets 416 are receivable on the shank 460 and the rib 488 adjacent the second clamp 466 during assembly of the wall 404.

The saddle 474 is slidably mounted on an upper plate of the support 470 and includes a first mount 496 for carrying a first reinforcement member 418 such as rebar and a second mount 498 for carrying a second reinforcement member 426 such as rebar. As can be understood from FIGS. 10 and 13, the saddle 474 is slidable on the support 470 between the blocks 408. Such adjustability of the saddle 474 permits the first and/or second reinforcement members 418 and 426 held in the first and second mounts 496 and 498 to be positioned within the central layer 432 relatively closer to one set of the blocks 408 or the other set of the blocks 408, depending upon the needs of the specific application. For instance, if it is known that one set of the blocks will sustain a load against them, such as if it will have the grade disposed against it along a meaningful portion of its vertical extent, the saddle 474 may be disposed closer to the load-bearing set of blocks 408 in order to provide additional support to such blocks 408.

Figure 13:
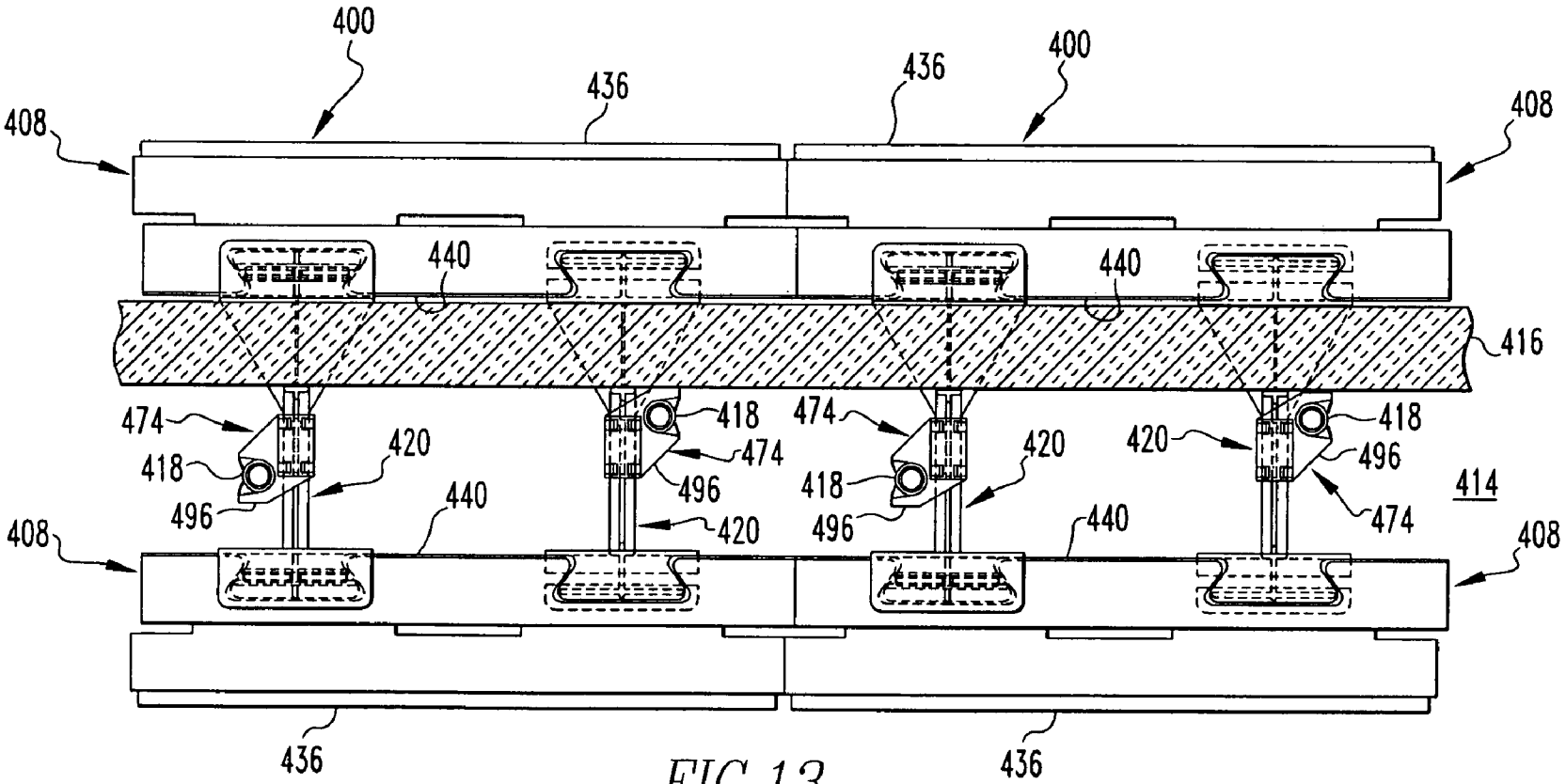
FIG. 13 is a top plan view of a plurality of the construction units during assembly of a wall in accordance with the second embodiment of the present invention.

As can be understood from FIG. 13, the first reinforcement members 418 are oriented substantially parallel with both sets of blocks 408, and the second reinforcement members 426 are likewise oriented substantially parallel with both sets of blocks 408. Since the first and second reinforcement members 418 and 426 are oriented substantially perpendicular to one another, the saddle 474 avoids interference therebetween by offsetting the first mount 496 from the second mount 498 along a direction extending generally between the first and second clamps 462 and 466, and thus between the opposed blocks 408 of each construction unit 400.

Once the construction units 400 have been assembled together with one another, and the insulation sheets installed therein, if desired, and the first and second reinforcement members 418 and 426 mounted in the first and second mounts 496 and 498, as desired, and the saddles 474 slidably positioned in a desirable location between the first and second clamps 462 and 466, the material of the central layer 432 can be delivered into the portion of the space 414 between the insulation sheets 416 and the set of blocks 408 spaced therefrom. Upon curing or setting, the material of the construction unit 400 is disposed within the portion of the slots 444 that are available, as well as extends through the openings 492 of the supports 470.

A third embodiment of the present invention is indicated generally in FIGS. 15-19. Specifically, an improved wall system 506 in accordance with the third embodiment is indicated generally in FIG. 15. The wall system 506 can be used to form a wall 504 (FIG. 19) in accordance with the third embodiment. The wall system 506 is similar to the wall system depicted in FIG. 2 except that it employs different ties. The wall system 506 includes a plurality of blocks 508 and 512 and a number of insulation sheets 516, with a plurality of ties 520, 620, and 720 extending between the blocks 508 and 512 and the insulation sheets 516.

The tie 520 is similar to the tie 20 in that it includes a plurality of semi-circular first flanges 580 at one end thereof and a plurality of rectangular second flanges 584 at an opposite end thereof. The tie 520 additionally includes a strut 590 having a shank 560 and a rib 588. The rib 588 includes a plurality of sockets 598 formed in an upper portion thereof. As will be discussed in greater detail below, one of the primary differences between the tie 520 and the tie 20 is that the strut 590 is configured differently than the strut 90.

The tie 620 includes a strut 690, and the tie 720 includes a strut 790. The ties 620 and 720 are similar to the ties 120 and 220, respectively, although the struts 690 and 790 are different than the struts 190 and 290 of the ties 120 and 220. Specifically, the tie 620 includes a plurality of generally semi-circular first flanges 680 and a first flange extension 682 at one end thereof, as well as a plurality of generally rectangular second flanges 684 and a plurality of generally rectangular second flange extensions 686 at another end, which is similar to the tie 120. However, the strut 690 includes a shank 660 and a rib 688, with the rib 688 including a plurality of sockets 698 formed in an upper portion thereof. The tie 720 includes a plurality of generally semi-circular first flanges 780 and a plurality of first flange extensions 782 at one end thereof, as well as a plurality of generally rectangular second flanges 784 and plurality of second flange extensions 786 at another end thereof, which is similar to the tie 220. However, the strut 790 includes a shank 760 and rib 788, with the rib 788 including a plurality of sockets 798 formed in an upper portion thereof.

Figures 17, 17A:
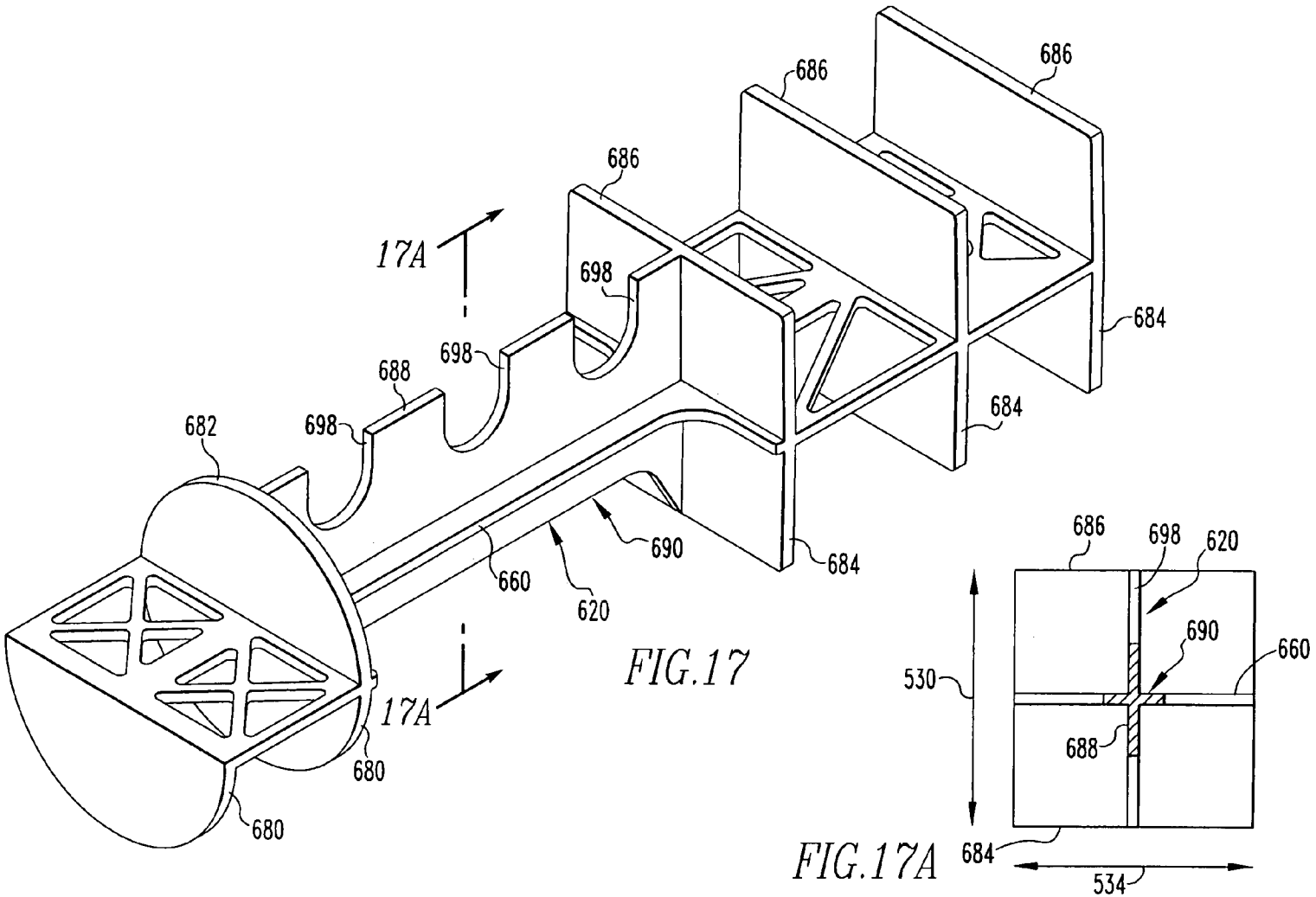
FIG. 17 is a perspective view of another tie in accordance with the third embodiment.
FIG. 17A is a sectional view as taken along line 17A-17A of FIG. 17.
Figure 18:
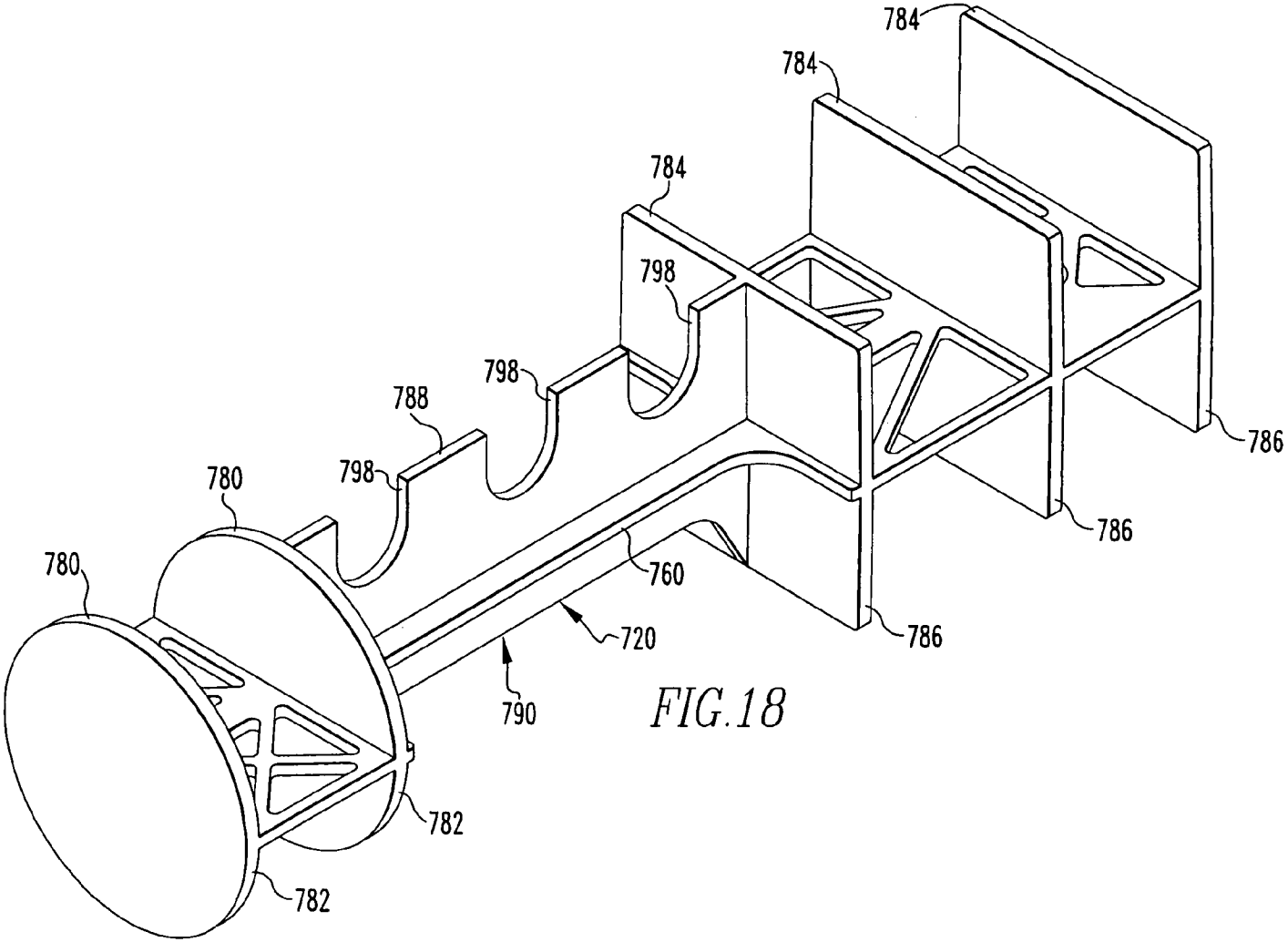
FIG. 18 is a perspective view of another tie in accordance with the third embodiment.

After the blocks 508 and 512 are connected with the insulation sheets 516 by mounting the ties 520, 620, and 720 therebetween, a coextensive space 514 is defined between the blocks 508 and 512 and the insulation sheets 516. As can be understood from FIGS. 16-18, the portions of the struts 590, 690, and 790 that extend through the space 514, and that thus will extend through the central layer 532 of the wall 504, are substantially similar to one another. FIG. 17A indicates that the portions of the struts 590, 690, and 790 that extend through the central layer 532 are generally taller in a vertical direction 530 than they are wide in a horizontal direction 534. It can be understood from FIGS. 17 and 17A that the shank 660 flares outwardly in the horizontal direction 534 only at points immediately adjacent one of the first flanges 680 and one of the second flanges 684, and the remainder of the shank 660 is substantially relatively narrower than such flared portions. The shanks 560 and 760 are similar in this regard to the shank 660.

The ribs 588, 688, and 788 are of a first area extending along the vertical direction 530, and the corresponding portions of the shanks 560, 660, and 760 are of a second area extending generally in the horizontal direction 534. The first areas advantageously are larger than the corresponding second areas. The struts 590, 690, and 790 can therefore be said to be taller than they are wide.

The struts 590, 690, and 790 are thus stiffer in bending in the vertical direction 530 than in the horizontal direction 534. In this regard, it is noted that bending in the vertical direction 530 refers to bending about an imaginary axis in the horizontal direction 534, and that bending in the horizontal direction 534 refers to bending about an imaginary axis in the vertical direction 530. While it is understood that the bending stiffness of a structure is generally a function of the area moment of inertia of the structure, which follows the formula $bh^3/12$, it can be understood from FIGS. 16-18 that the relatively greater vertical area than the horizontal area of the struts 590, 690, and 790 results in their being relatively stiffer in the vertical direction than in the horizontal direction.

Figure 19:
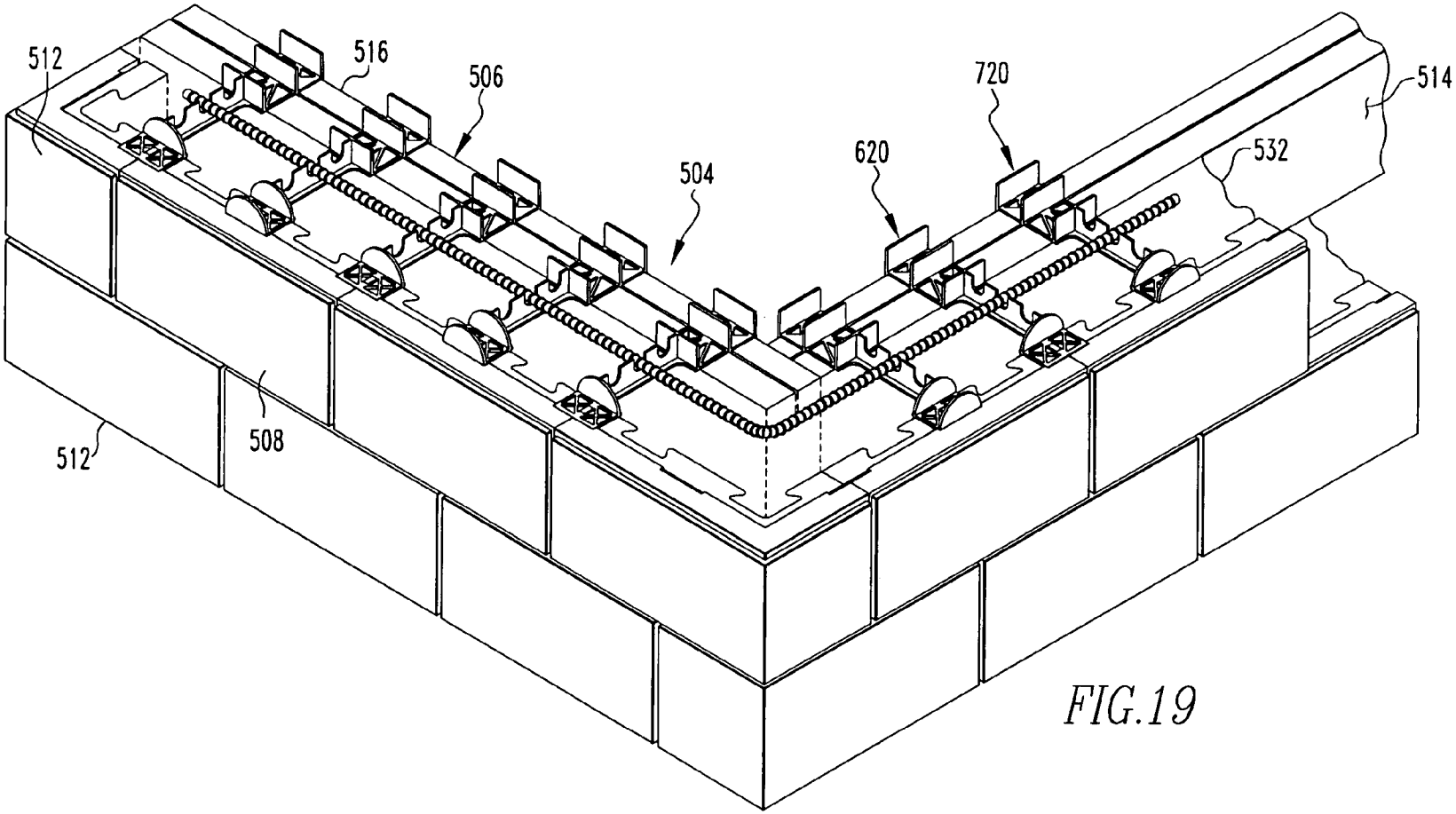
FIG. 19 is a perspective view of a portion of a wall in accordance with the third embodiment.

It can be understood from FIG. 19 that any of a plurality of the sockets 598, 698, and 798 can receive a reinforcement member 526 therein for purposes of strengthening and reinforcement. By providing the multiplicity of the sockets 598, 698, and 798, the reinforcement member 526 can be disposed relatively closer to the blocks 508 or the insulation sheets 516, and can be midway therebetween, depending upon the desired strengthening effect that is to be achieved with the use of the reinforcement member 526. In this regard, the multiplicity of sockets 598, 698, and 798, permit the position of the reinforcement member 526 to be varied within the interior of the central layer 532 in order to provide specified strengthening characteristics to the central layer 532 and thus to the wall 504. Multiple reinforcement members 526 may be employed, whereby multiple sockets 598, 698, and 798 of each of a plurality of the ties 520, 620, and 720 may carry reinforcement members 526.

By providing the struts 590, 690, and 790 with a profile that is relatively tall (in the vertical direction 530) and narrow (in the horizontal direction 534) for the portion thereof that extends through the central layer 532, the material that will make up the central layer 532 can be poured into the space 514 between the blocks 508 and the insulation sheets 516 and be permitted to drop in the vertical direction 530 during the filling of such space 514 generally without resistance by relatively large structures extending in the horizontal direction 534. The relatively tall and narrow profiles of the portions of the struts 590, 690, and 790 that extend through the central layer 532 thus facilitate the pouring and formation of the central layer 532.

A wall 804 and wall system 806 in accordance with a fourth embodiment of the present invention are indicated generally in FIGS. 20-23. The wall system 806 includes a plurality of blocks 808 and 812 and a plurality of insulation sheets 816, with a plurality of ties 820 and 920 extending between the blocks 808 and 812 and the insulation sheets 816 to provide a coextensive space 814 therebetween. A curable or settable material is poured into the space 814 to form a central layer 832 of the wall 804. The ties 820 and 920 are similar to the ties 20 and 220, respectively, but are different in the fashion with which they connect with the blocks 808 and 812.

The tie 820 includes a strut 890 having a shank 860 and rib 888, with the rib 888 including a plurality of sockets 898 formed in an upper portion thereof. The tie 820 additionally includes a plurality of substantially rectangular flanges 884 and flange extensions 888 at one end thereof, and includes an anchor 880 at another end thereof. The anchor 880, in accordance with the present invention, is cooperable with a slot 844 having a constricted throat 846 formed in each of the blocks 808 and 812.

Each anchor 880 includes a tapered plug 838, an abutment member 850, and a stop 854. The flanges 884, the rib 888, the plug 838, and the abutment member 850 all extend outwardly in the same direction from the same face of the shank 860. The stop 854 is generally coplanar with the shank 860.

Figure 20:
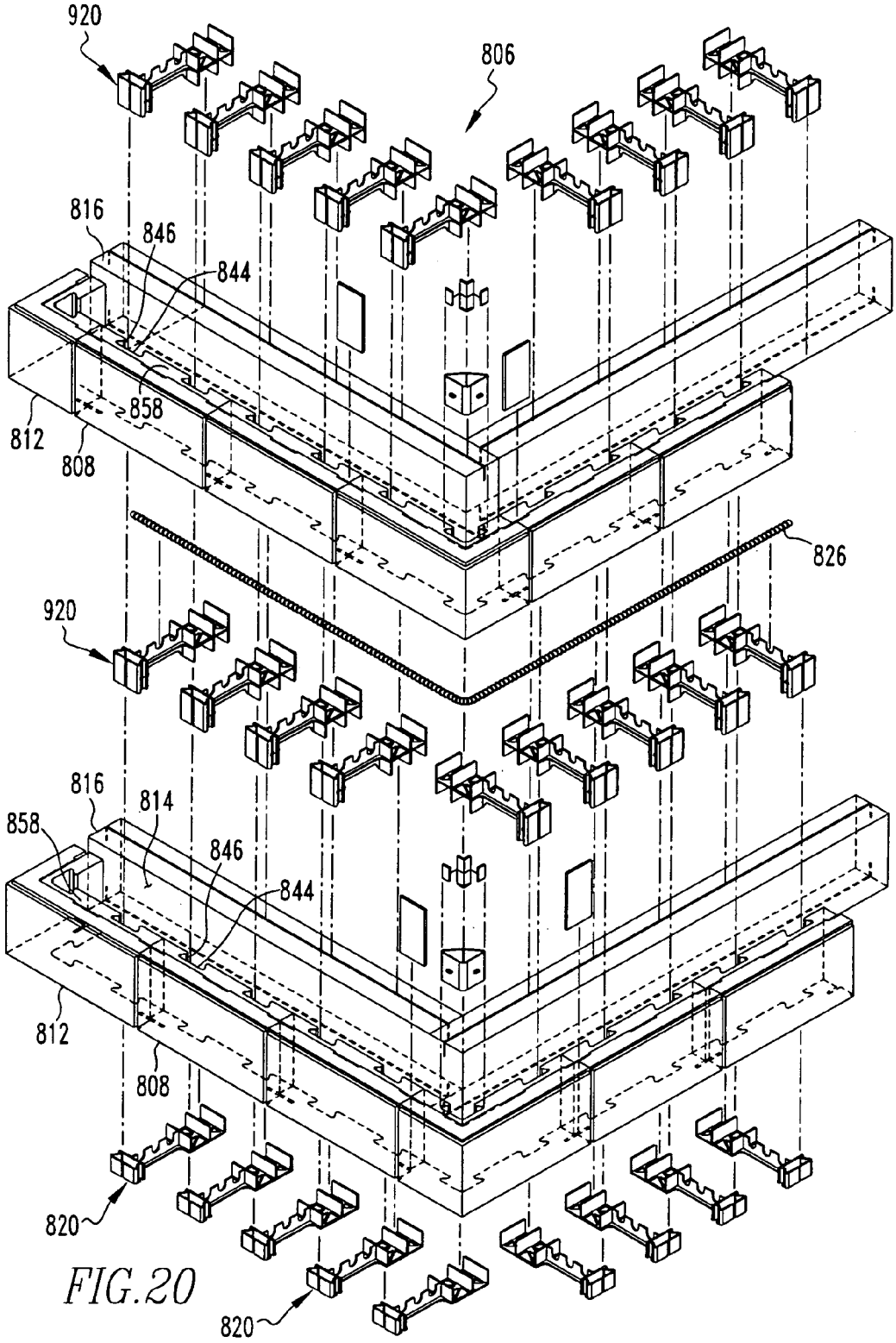
FIG. 20 is an exploded perspective view of a wall system constituting a portion of a wall in accordance with a fourth embodiment of the present invention.
Figure 21:
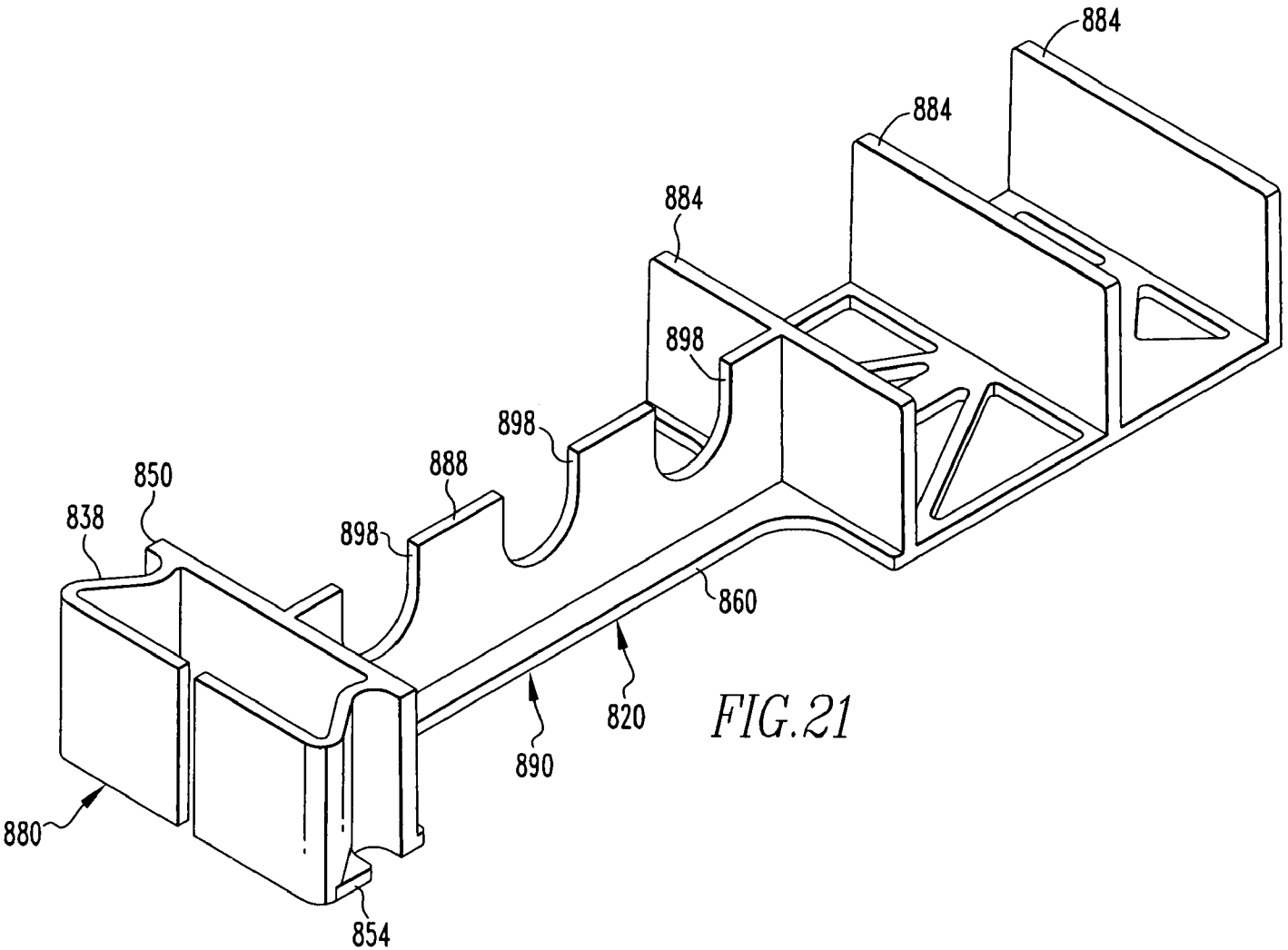
FIG. 21 is a perspective view of a tie in accordance with the fourth embodiment.
Figure 22:
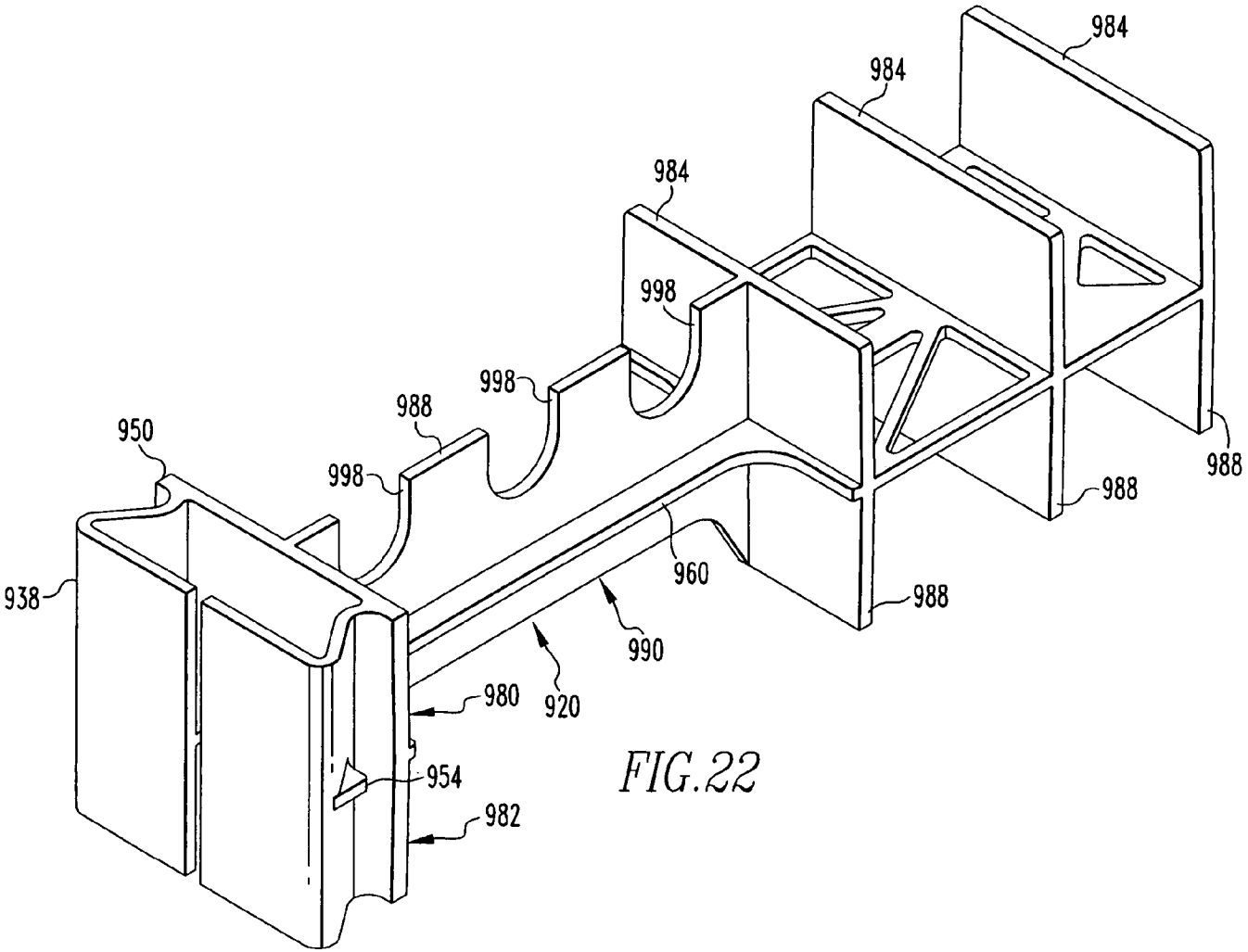
FIG. 22 is a perspective view of another tie in accordance with the fourth embodiment.
Figure 23:
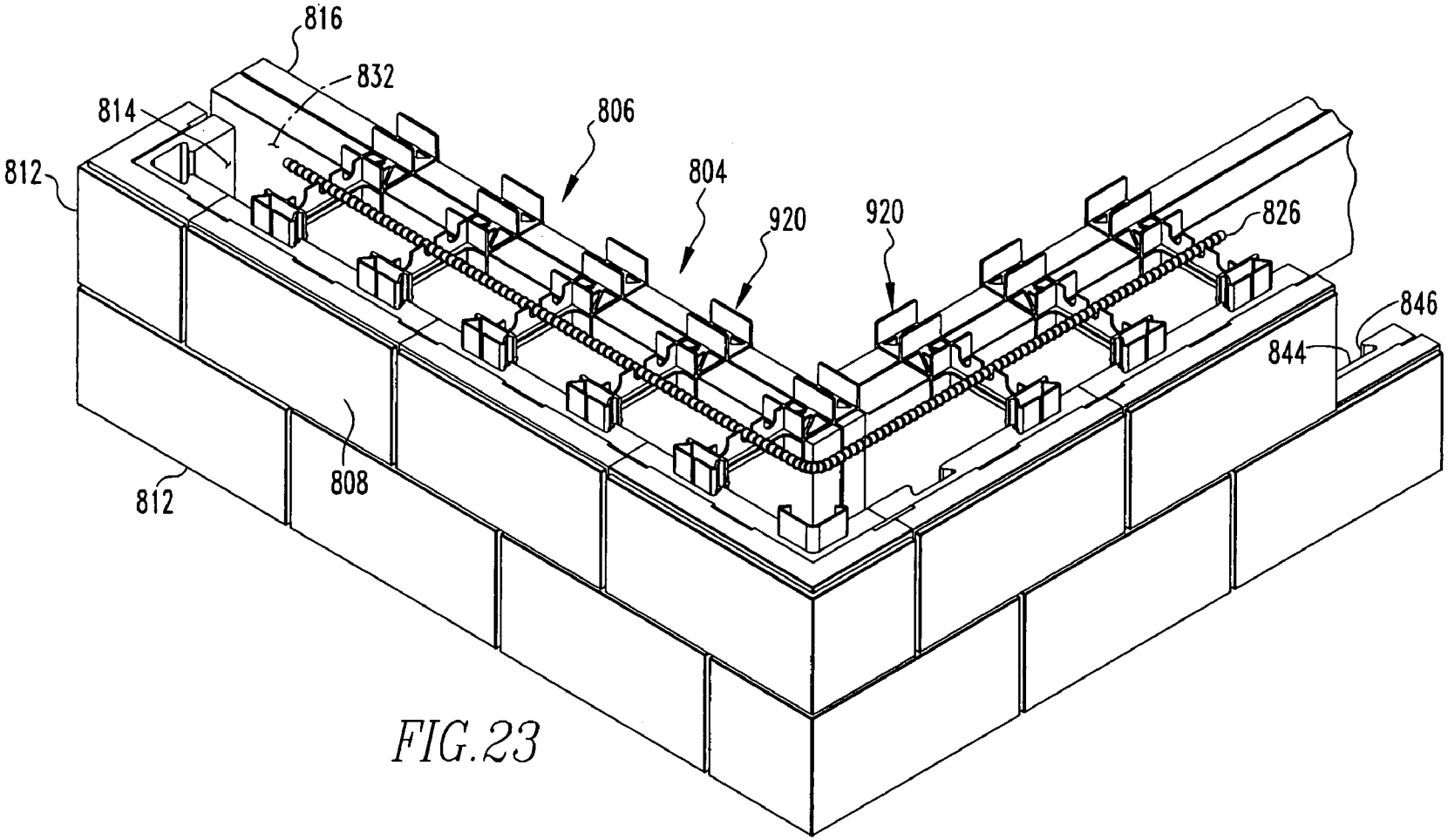
FIG. 23 is a perspective view of a portion of the wall system of the fourth embodiment prior to adding the layer of settable material to form the wall of the fourth embodiment.

It can be understood from FIG. 20 that the plug 838 is tapered and is receivable in the slot 844 and is retained therein by the constricted throat 846. The abutment member 850 is disposed against an interior surface of the blocks 808 and 812 adjacent the constricted throat 846. The stop 854 is receivable in a step 858 of the blocks 808 and 812 in order to limit movement of the anchor 880 in a direction generally parallel with the slots 844.

The tie 920 similarly includes a strut 990 having a shank 960 and a rib 988, with the rib 988 including a plurality of sockets 998 formed in an upper portion thereof. The tie 920 includes a plurality of generally rectangular flanges 984 at one end thereof, but additionally includes a plurality of generally rectangular flange extensions 988. The tie 920 also includes an anchor 980 at another end thereof, as well as an anchor extension 982 that corresponds with the anchor 980. The anchor 980 and the anchor extension 982 together provide a tapered plug 938 and an abutment member 950, with a stop 954 being disposed on the plug 938 generally coplanar with the shank 960.

As can be understood from FIG. 20, the ties 820 are disposed beneath a first course of the blocks 808 and 812. The ties 920 are disposed between adjacent courses of blocks 808 and 812.

The portions of the struts 890 and 990 that extend through the central layer 832 are advantageously of a relatively tall and narrow configuration similar to the struts 590, 690, and 790. Also advantageously, since the ties 820 and 920 are cooperable with the slots 844, it is necessary only to provide the two ties 820 and 920 to construct the wall 804, instead of the three ties required with the first and third embodiments, as set forth above.

In all of the embodiments of the invention described herein, the central layer of the wall is generally formed at least partially within the elongated slots of the blocks. In the fourth embodiment, the tapered plugs 838 and 938 of the ties 820 and 920 are likewise received in the slots 844. A reinforcement member 826 is receivable in any of the sockets 898 and 998 depending upon the desired strengthening effect to be provided to the wall 804.

It is noted that any of the wall systems described above can include an additional set of blocks adjacent the insulation sheets opposite the central layer. Such additional set of blocks could be provided in order to provide an additional substantially aesthetically complete surface and/or a masonry external surface, which further increases the versatility of the wall systems described herein.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A wall comprising:

a first layer including a substantially aesthetically completed exterior surface, and comprising a plurality of first blocks formed with at least a first receptacle on a top surface thereof and a second receptacle on a bottom surface thereof, wherein the first receptacle is co-extensive with the second receptacle;

a second layer formed with a slit on a top side and a bottom side thereof;

a third layer interposed between the first and second layers;

the third layer being a layer of a cementitious material formed between the first and second layers; and at least a first tie extending between the first and second layers, and comprising:

a strut, the strut including a first face and a second face opposite one another;

a plurality of first flanges disposed on the strut and extending outwardly from the first face, the first flanges being substantially parallel with one another and spaced apart from one another; and an anchor having a bottom side coplanar with the strut.

2. The wall as set forth in claim 1, the third layer being formed between the first and second layers and being received in at least a portion of the first and second receptacles.

3. The wall as set forth in claim 1, in which the second layer is formed at least partially of an insulative material.

4. The wall as set forth in claim 1, in which the second layer includes a substantially aesthetically completed exterior surface.

5. The wall as set forth in claim 4, in which the first layer is formed of a plurality of first blocks, and in which the second layer is formed of a plurality of second blocks, the at least first tie extending between one of the first blocks and one of the second blocks.

6. The wall as set forth in claim 5, in which the at least first tie, the one of the first blocks, and the one of the second blocks together form an assembled construction unit.

7. The wall as set forth in claim 6, in which the wall is formed of a plurality of the assembled construction units.

8. The wall as set forth in claim 1, in which the third layer includes at least a first reinforcement member.

9. The wall as set forth in claim 8, in which the strut of the at least first tie comprises a rib disposed on the first face, and which includes at least a first socket formed therein, the at least first reinforcement member being disposed in the socket.

10. The wall as set forth in claim 8, in which the strut of the at least first tie includes a plurality of sockets formed therein, the at least first reinforcement member being disposed in one of the sockets depending upon the strengthening effect desired from the at least first reinforcement member.

11. The wall as set forth in claim 1, in which at least a portion of the strut of the at least first tie extends generally through the third layer, the at least portion of the strut extending generally through the third layer having a greater degree of stiffness in a vertical direction than in a horizontal direction.

12. The wall as set forth in claim 1, in which at least a portion of the strut of the at least first tie extends generally through the third layer, the at least portion of the strut that extends through the third layer having a vertical area and a horizontal area, the vertical area being greater than the horizontal area.

13. The wall as set forth in claim 1, in which at least a portion of the strut of the at least first tie extends through the third layer and has a vertical dimension and a horizontal dimension, the vertical dimension being generally greater than the horizontal dimension.

14. The wall as set forth in claim 1, in which the first receptacle on the top surface of the plurality of first blocks and the second receptacle on the bottom surface of the plurality of first blocks each includes a constricted throat, and in which the anchor of the first tie includes a plug, at least a portion of the plug being received in the constricted throat of the second receptacle.

15. The wall as set forth in claim 14, in which the anchor of the at least first tie includes an abutment member disposed adjacent the plug, and in which the abutment member is disposed against the bottom surface of the plurality of first blocks and adjacent to the second receptacle.

16. The wall as set forth in claim 1, wherein at least one of the flanges of the plurality of first flanges is disposed in the slit on the bottom side of the second layer such that the first face of the strut abuts the bottom side of the second layer, and wherein the anchor is disposed within the second receptacle such that the bottom side of the anchor abuts the bottom surface of the plurality of first blocks.

17. The wall as set forth in claim 1, wherein the at least first tie further comprises a plurality of second flanges disposed on the strut and extending outwardly from the second face, the second flanges being substantially parallel with one another and spaced apart from one another.

18. The wall as set forth in claim 17, wherein at least one of the flanges of the plurality of second flanges is disposed in the slit on the top side of the second layer such that the second face of the strut abuts the top side of the second layer, and wherein the anchor is disposed within the first receptacle such that the bottom side of the anchor abuts the top surface of the plurality of the first blocks.

19. The wall set forth in claim 18, in which the third layer includes at least a first reinforcement member; and in which the strut of the at least first tie includes a plurality of sockets formed therein, the at least first reinforcement member being disposed in one of the sockets depending upon the strengthening effect desired from the at least first reinforcement member.

20. A wall comprising:

a first layer comprising a plurality of first blocks formed with at least a first receptacle on a top surface thereof and a second receptacle on a bottom surface thereof, wherein the first receptacle is co-extensive with the second receptacle;

a second layer formed with a slit on a top side and a bottom side thereof;

a third layer interposed between the first and second layers, the third layer being a layer of a cementitious material formed between the first and second layers;

at least one of a first tie extending between the first and second layers, and comprising:

a strut, the strut including a first face and a second face opposite one another;

a plurality of first flanges disposed on the strut and extending outwardly from the first face, the first flanges being substantially parallel with one another and spaced apart from one another; and an anchor having a bottom side coplanar with the strut;

wherein at least one of the flanges of the plurality of first flanges is disposed in the slit on the bottom side of the second layer such that the first face of the strut of the at least one of the first tie abuts the bottom side of the second layer, and wherein the anchor of the at least one of the first tie is disposed within the second receptacle such that the bottom side of the anchor of the at least one of the first tie abuts the bottom surface of the plurality of first blocks; and at least one of a second tie extending between the first and second layers, and comprising:

a strut, the strut including a first face and a second face opposite one another;

a plurality of first flanges disposed on the strut of the at least one of the second tie and extending outwardly from the first face, the first flanges of the at least one of the second tie being substantially parallel with one another and spaced apart from one another;

a plurality of second flanges disposed on the strut of the at least on of the second tie and extending outwardly from the second face, the second flanges being substantially parallel with one another and spaced apart from one another; and an anchor having a bottom side coplanar with the strut;

wherein at least one of the flanges of the plurality of second flanges is disposed in the slit on the top side of the second layer such that the second face of the strut of the at least one of the second tie abuts the top side of the second layer, and wherein the anchor of the at least one of the second tie is disposed within the first receptacle such that the bottom side of the anchor of the at least one of the second tie abuts the top surface of the plurality of the first blocks.

* * * * *